US010781686B2

(12) United States Patent
Wang et al.

(10) Patent No.: US 10,781,686 B2
(45) Date of Patent: Sep. 22, 2020

(54) PREDICTION OF FLUID COMPOSITION AND/OR PHASE BEHAVIOR

(71) Applicant: Schlumberger Technology Corporation, Sugar Land, TX (US)

(72) Inventors: Kang Wang, Beijing (CN); Youxiang Zuo, Burnaby (CA); Younes Jalali, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 259 days.

(21) Appl. No.: 15/193,519

(22) Filed: Jun. 27, 2016

(65) Prior Publication Data

US 2017/0370214 A1 Dec. 28, 2017

(51) Int. Cl.
*G01V 1/40* (2006.01)
*E21B 47/10* (2012.01)

(52) U.S. Cl.
CPC ..... *E21B 47/10* (2013.01); *E21B 2200/22* (2020.05)

(58) Field of Classification Search
CPC ..... E21B 49/087
USPC ..... 702/11
See application file for complete search history.

(56) References Cited

U.S. PATENT DOCUMENTS 5,424,959 A 6/1995 Reyes et al.
7,081,615 B2 * 7/2006 Betancourt ..... E21B 47/10 250/255
7,526,953 B2 * 5/2009 Goodwin ..... E21B 47/10 250/255
7,920,970 B2 4/2011 Zuo et al.
7,966,273 B2 6/2011 Hegeman et al.
8,510,242 B2 8/2013 Al-Fattah
8,805,617 B2 8/2014 Zuo et al.
9,128,203 B2 9/2015 Saleh et al.
9,322,268 B2 * 4/2016 Zuo ..... E21B 49/10
9,416,647 B2 * 8/2016 Zuo ..... E21B 47/00
2013/0103627 A1 4/2013 Maddinelli
2014/0110167 A1 * 4/2014 Goebel ..... E21B 44/00 175/24
2014/0238122 A1 8/2014 Farshid et al.
2015/0308264 A1 10/2015 Zuo et al.
2016/0091389 A1 * 3/2016 Zuo ..... G01M 3/3272 73/49.2
2016/0146004 A1 * 5/2016 Wang ..... G01V 99/005 703/2

OTHER PUBLICATIONS

Siddiqui, 2015, A Derivative-less Approach for Generating Phase Envelopes. Oil Gas Res 1: 106.*

(Continued)

*Primary Examiner* — Toan M Le
*Assistant Examiner* — Xiuqin Sun
(74) *Attorney, Agent, or Firm* — Trevor G. Grove

(57) ABSTRACT

Apparatus and methods for obtaining first properties of a fluid, such as by estimating a second property of the fluid based on the first properties using a machine learning algorithm, propagating a first uncertainty of the first properties to a second uncertainty of the second property, generating an expected phase envelope of the fluid based on the second property, and generating a deviation phase envelope of the fluid based on the second uncertainty.

14 Claims, 15 Drawing Sheets

(56) References Cited

OTHER PUBLICATIONS

Whitson, C. H. Characterizing Hydrocarbon Plus Fractions. Society of Petroleum Engineers Journal, 1983, 23(04), 683-694. SPE-12233.
Zuo et al., Plus fraction characterization and PVT data regression for reservoir fluids near critical conditions. SPE Asia Pacific Oil and Gas Conference and Exhibition. Oct. 16-18, 2000, 12 pages, Society of Petroleum Engineers, Brisbane, Australia, SPE-64520.
Osman et al. Prediction of Oil PVT Properties Using Neural Networks. SPE Middle East Oil Show. Mar. 17-20, 2001. 14 pages, Society of Petroleum Engineers, SPE-68233.
El-Sebakhy et al., Support Vector Machines Framework for Predicting the PVT Properties of Crude Oil Systems. SPE Middle East Oil and Gas Show and Conference, Mar. 11-14, 2007. Bahrain. SPE-105698.
Hegeman et al., Application of Artificial Neural Networks to Downhole Fluid Analysis. Feb. 2009, SPE Reservoir Evaluation and Engineering, pp. 7-13. SPE 123423.
Fayazi et al., State-of-the-Art Least Square Support Vector Machine Application for Accurate Determination of Natural Gas Viscosity. Industrial & Engineering Chemistry Research, 2014 vol. 53, pp. 945-958.
Majidi et al., Evolving an Accurate Model Based on Machine Learning Approach for Prediction of Dew-Point Pressure in Gas Condensate Reservoirs. Chemical Engineering Research and Design, 2014 vol. 92 (5), pp. 891-902.
Bagheripour et al., Support Vector Regression Between PVT Data and Bubble Point Pressure. Journal of Petroleum Exploration and Production Technology, Mar. 2, 2014. pp. 227-231.
Zuo et al., EOS-Based Downhole Fluid Characterization. Society of Petroleum Engineers Journal vol. 16 (1), Mar. 2011, pp. 115-124.

* cited by examiner

PREDICTION OF FLUID COMPOSITION AND/OR PHASE BEHAVIOR

BACKGROUND OF THE DISCLOSURE

Wellbores or boreholes may be drilled to, for example, locate and produce hydrocarbons. During a drilling operation, properties of encountered formations and formation fluids may be evaluated and/or measured. Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a processing system having a processor and a memory including computer program code, as well as a method of operating the processing system to obtain first properties of a fluid, estimate a second property of the fluid based on the first properties using a machine learning algorithm, propagate a first uncertainty of the first properties to a second uncertainty of the second property, generate an expected phase envelope of the fluid based on the second property, and generate a deviation phase envelope of the fluid based on the second uncertainty.

The present disclosure introduces an apparatus that includes a processing system having a processor and a memory including computer program code, as well as a method of operating the processing system to obtain compositional component weight fractions of a fluid. The compositional component weight fractions include a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction. The method also includes operating the processing system to estimate, using a machine learning algorithm, a hydrocarbons C6+ mole fraction of the fluid based on the compositional component weight fractions. The method also includes operating the processing system to generate a hydrocarbons C6+ molar mass based on the hydrocarbons C6+ mole fraction, and generate compositional component mole fractions based on the hydrocarbons C6+ molar mass and the hydrocarbons C6+ mole fraction. The compositional component mole fractions include a hydrocarbon C1 mole fraction, a hydrocarbon C2 mole fraction, a hydrocarbon C3 mole fraction, a hydrocarbon C4 mole fraction, and a hydrocarbon C5 mole fraction.

The present disclosure introduces an apparatus that includes a processing system having a processor and a memory including computer program code, as well as a method of operating the processing system to estimate expected hydrocarbon mole fractions of a fluid, propagate uncertainties to the expected hydrocarbon mole fractions based on the estimating, generate an expected phase envelope of the fluid based on the expected hydrocarbon mole fractions, and generate a deviation phase envelope of the fluid based on one or more of the uncertainties.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of description.

DETAILED DESCRIPTION

Figure 1:
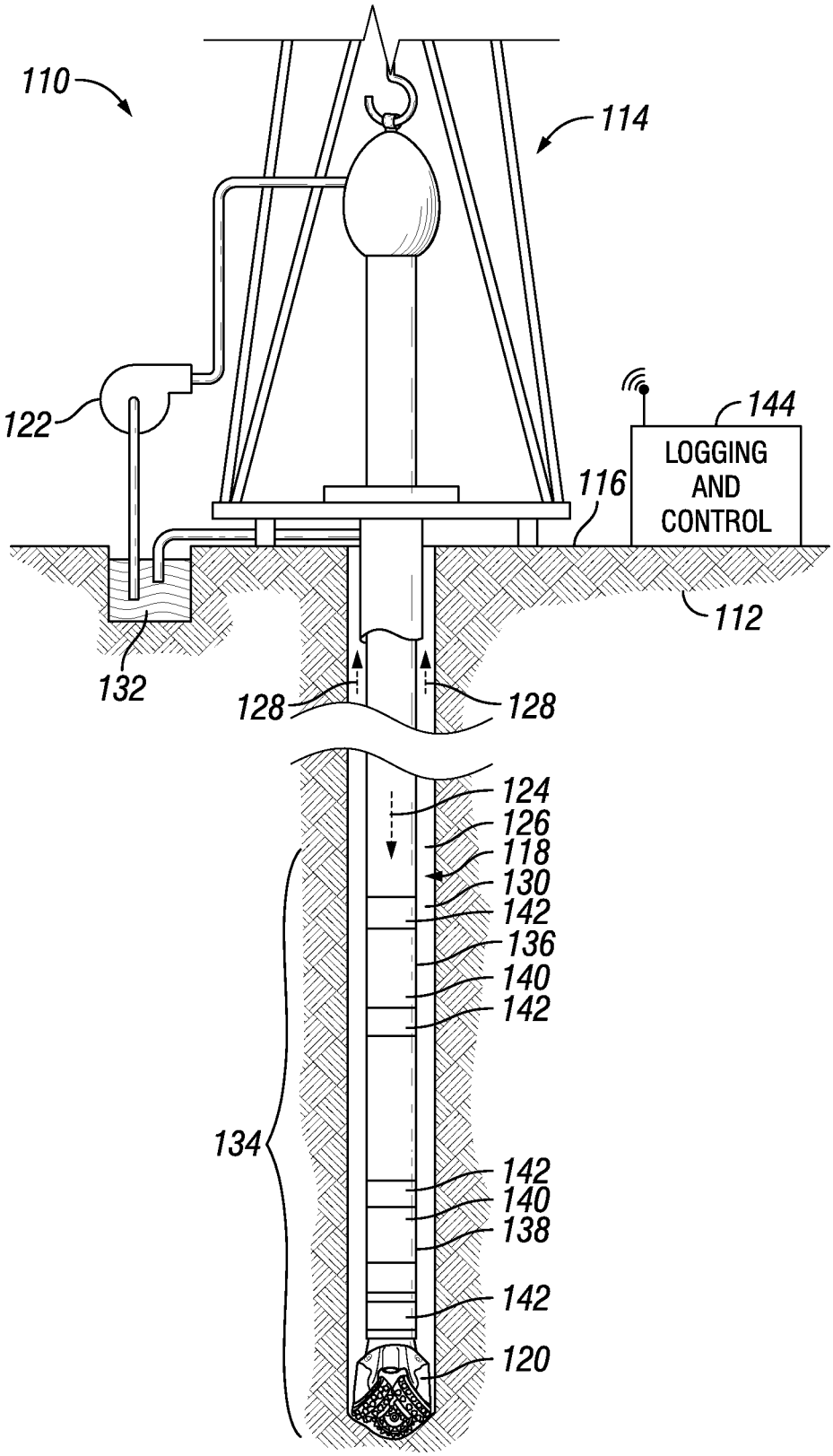
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations described herein.

Systems and methods and/or processes according to one or more aspects of the present disclosure may be used or performed in connection with formation evaluation using fluid sampling and analysis. For example, composition and phase behavior of a fluid can implicate operation decisions for a wellsite. One or more aspects disclosed herein may permit predicting composition and phase behavior of a fluid in real-time and in situ at the wellsite. This real-time information may be used to direct operation decisions, such as drilling depth and/or direction, among others.

One or more aspect of the present disclosure may provide for prediction of an expected composition and/or phase behavior of a fluid in a subterranean formation. In some example implementations, a machine learning algorithm is trained on data of historical samples, and the machine learning algorithm is used to predict one or more properties of the fluid, such as one or more compositional components of the fluid. For example, during downhole fluid analysis (DFA), properties of the fluid may be obtained. These properties may be input to the machine learning algorithm, and the machine learning algorithm may output the predicted one or more properties, such as the one or more compositional components. Other predicted properties, such as other compositional components, may be determined based on the one or more properties predicted by the machine learning algorithm. The predicted properties may define an expected aspect of the fluid, such as an expected composition. Using a thermodynamics model, an expected phase envelope may be generated based on an expected composition of the fluid.

One or more aspects of the present disclosure may provide for estimating a deviation range of the phase envelope of the fluid. Uncertainties may arise during obtaining the predicted properties. These uncertainties may be propagated to the respective predicted properties such that the predicted compositional component has an uncertainty. Based on the uncertainties of the predicted properties, a deviation range for the phase envelope of the fluid may be estimated.

The above-described prediction of fluid properties and phase envelopes may be performed in situ during DFA and may be provided real-time. This information may increase productivity and efficiency of wellsite operations. Some example systems are provided herein for context to understand one or more aspects of methods and/or processes disclosed herein. A person having ordinary skill in the art will readily understand that one or more aspects of methods and/or processes disclosed herein may be used in other contexts, including other systems in which information relating to composition of a fluid and/or phase behavior of a fluid may be useful.

FIG. 1 is a schematic view of at least a portion of an example implementation of a drilling system 110 operable to drill a wellbore 126 into one or more subsurface formations 112. One or more aspects described above may be performed by or in conjunction with one or more aspects of the drilling system 110 shown in FIG. 1.

A drilling rig 114 at the wellsite surface 116 is operable to rotate a drill string 118 that includes a drill bit 120 at its lower end. As the drill bit 120 is rotated, a pump 122 pumps drilling fluid, such as oil-based mud (OBM) in this example, downward through the center of the drill string 118 in the direction of arrow 124 to the drill bit 120. The OBM cools and lubricates the drill bit 120 and exits the drill string 118 through ports (not shown) in the drill bit 120. The OBM then carries drill cuttings away from the bottom of the wellbore 126 as it flows back to the wellsite surface 116 through an annulus 130 between the drill string 118 and the subsurface formation 112, as shown by arrows 128. At the wellsite surface 116, the return OBM is filtered and conveyed back to a mud pit 132 for reuse.

While a drill string 118 is illustrated in FIG. 1, it will be understood that implementations described herein may be applicable or readily adaptable to work strings and wireline tools as well. Work strings may include a length of tubing (e.g., coiled tubing) lowered into the wellbore 126 for conveying well treatments or well servicing equipment. Wireline tools may include formation testing tools suspended from a multi-conductor cable as the cable is lowered into the wellbore 126 to measure formation properties at depths, as described in more detail below.

The location and environment of the drilling system 110 may vary depending on the subsurface formation 112 penetrated by the wellbore 126. Instead of being a surface operation, for example, the wellbore 126 may be formed under water of varying depths, such as on an ocean bottom surface. Some components of the drilling system 110 may be specially adapted for underwater wells in such instances.

The lower end of the drill string 118 includes a bottom-hole assembly (BHA) 134, which includes the drill bit 120 and a plurality of drill collars 136, 138. The drill collars 136, 138 may include various instruments, such as sample-while-drilling (SWD) tools that include sensors, telemetry equipment, and so forth. For example, the drill collars 136, 138 may include logging-while-drilling (LWD) modules 140 and/or measurement-while drilling (MWD) modules 142. The LWD modules 140 may include tools operable to measure formation parameters and/or fluid properties, such as resistivity, porosity, permeability, sonic velocity, optical density (OD), pressure, temperature, and/or other example properties. The MWD modules 142 may include tools operable to measure wellbore trajectory, borehole temperature, borehole pressure, and/or other example properties. The LWD modules 140 may each be housed in one of the drill collars 136, 138, and may each contain one or more logging tools and/or fluid sampling devices. The LWD modules 140 include capabilities for measuring, processing, and/or storing information, as well as for communicating with the MWD modules 142 and/or with surface equipment such as, for example, a logging and control unit 144. That is, the SWD tools (e.g., LWD modules 140 and MWD modules 142) may be communicatively coupled to the logging and control unit 144 disposed at the wellsite surface 116. In other implementations, portions of the logging and control unit 144 may be integrated with downhole features.

The LWD modules 140 and/or the MWD modules 142 may include a downhole formation fluid sampling tool operable to selectively sample fluid from the subsurface formation 112. The drilling system 110 may be operable to determine, estimate, or otherwise obtain various properties associated with the sampled formation fluid. These properties may be determined within or communicated to the logging and control unit 144, such as for subsequent utilization as input to various control functions and/or data logs.

Figure 2:
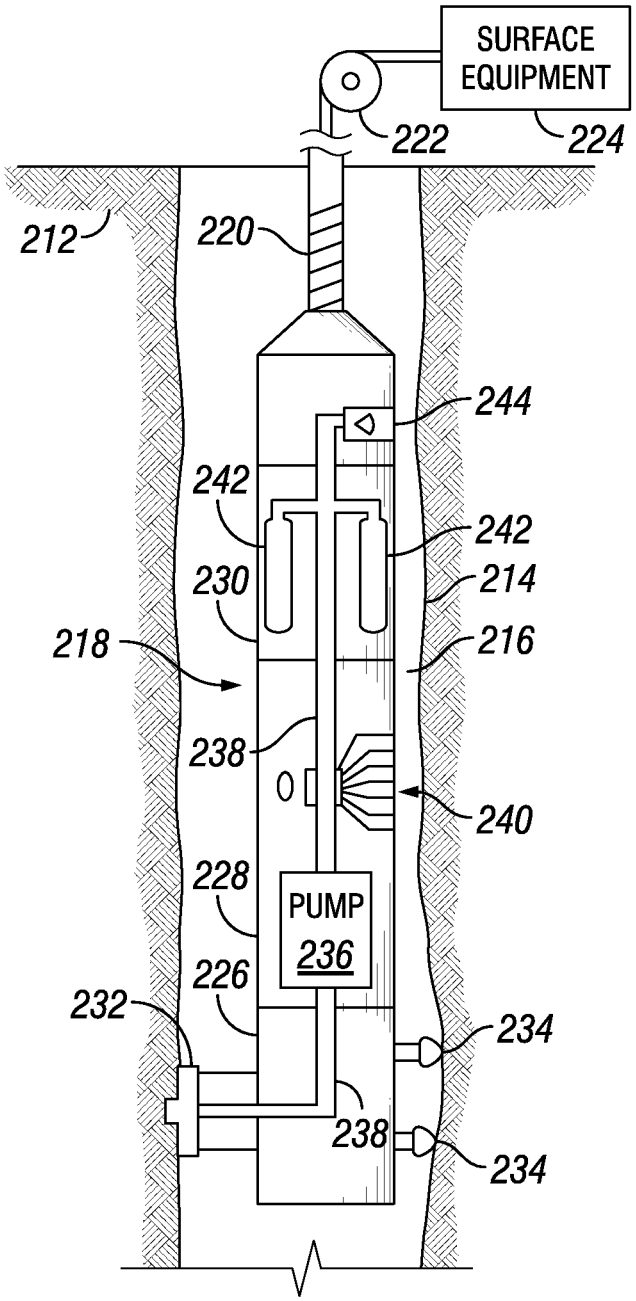
FIG. 2 is a schematic view of at least a portion of an example implementation of apparatus according to one or more aspects of the present disclosure.

FIG. 2 is a schematic diagram of an example implementation of downhole equipment (equipment configured for operation downhole) operable to sample fluid from a formation, such as the subsurface formation 212 shown in FIG. 2. The downhole equipment includes an example implementation of a downhole formation fluid sampling tool 218, hereinafter referred to as the downhole tool 218. The downhole tool 218 is conveyable within the wellbore 214 to the subsurface formation 212 and subsequently operable to sample formation fluid from the subsurface formation 212. In the illustrated example implementation, the downhole tool 218 is conveyed in the wellbore 214 via a wireline 220. The downhole tool 218 may be suspended in the wellbore 214 from a lower end of the wireline 220, which may be a multi-conductor cable spooled from a winch 222 at the surface. The wireline 220 may be electrically coupled to wellsite surface equipment 224, such as to communicate various control signals and logging information between the downhole tool 218 and the wellsite surface equipment 224. The wellsite surface equipment 224 shown in FIG. 2 and the logging and control unit 144 shown in FIG. 1, or functions thereof, may be integrated in a single system at the wellsite surface.

The downhole tool 218 includes a probe module 226, a pumpout module 228, and a sample module 230, one or more of which may comprise, be part of, be substantially similar to, or otherwise have similar functionality relative to one or more of the SWD tools, LWD modules 140, and/or MWD modules 142 shown in FIG. 1 and/or described above. However, other arrangements and/or modules may make up the downhole tool 218.

The probe module 226 may comprise an extendable fluid communication line (probe 232) operable to engage the subsurface formation 212 and communicate fluid samples from the subsurface formation 212 into the downhole tool 218. The probe module 226 may also comprise one or more setting mechanisms 234. The setting mechanisms 234 may include pistons and/or other apparatus operable to improve sealing engagement and thus fluid communication between the subsurface formation 212 and the probe 232. The probe module 226 may also comprise one or more packer elements (not shown) that inflate or are otherwise operable to contact an inner wall of the wellbore 214, thereby isolating a section of the wellbore 214 for sampling. The probe module 226 may also comprise electronics, batteries, sensors, and/or hydraulic components used, for example, to operate the probe 232 and/or the corresponding setting mechanisms 234.

The pumpout module 228 may comprise a pump 236 operable to create a pressure differential that draws the formation fluid in through the probe 232 and pushes the fluid through a flowline 238 of the downhole tool 218. The pump 236 may comprise an electromechanical, hydraulic, and/or other type of pump operable to pump formation fluid from the probe module 226 to the sample module 230 and/or out of the downhole tool 218. The pump 236 may operate as a piston displacement unit (DU) driven by a ball screw coupled to a gearbox and an electric motor, although other types of pumps 236 are also within the scope of the present disclosure. Power may be supplied to the pump 236 via other components located in the pumpout module 228, or via a separate power generation module (not shown). During a sampling period, the pump 236 moves the formation fluid through the flowline 238 toward the sample module 230.

The pumpout module 228 may also include a spectrometer 240 operable to measure characteristics of the formation fluid as it flows through the flowline 238. The spectrometer 240 may be located downstream or upstream of the pump 236. The characteristics sensed by the spectrometer 240 may include OD of the formation fluid. Data collected via the spectrometer 240 may be utilized to control the downhole tool 218. For example, the downhole tool 218 may not operate in a sample collection mode until the formation fluid flowing through the flowline 238 exhibits characteristics of a clean formation fluid sample, as detected by or otherwise determined in conjunction with operation of the spectrometer 240. A clean formation fluid sample contains a relatively low level of contaminants (e.g., drilling mud filtrate) that are miscible with the formation fluid when extracted from the subsurface formation 212.

The sample module 230 may comprise one or more sample bottles 242 for collecting samples of the formation fluid. Based on the OD and/or other characteristics of the formation fluid detected via sensors (e.g., the spectrometer 240) along the flowline 238, the downhole tool 218 may be operated in a sample collection mode or a continuous pumping (cleanup) mode. When operated in the sample collection mode, valves (not shown) disposed at or near entrances of the sample bottles 242 may be positioned to allow the formation fluid to flow into the sample bottles 242. The sample bottles 242 may be filled one at a time, and once a sample bottle 242 is filled, its corresponding valve may be moved to another position to seal the sample bottle 242. When the valves are closed, the downhole tool 218 may operate in a continuous pumping mode.

In the continuous pumping mode, the pump 236 moves the formation fluid into the downhole tool 218 through the probe 232, through the flowline 238, and then out of the downhole tool 218 through an exit port 244. The exit port 244 may be a check valve that releases the formation fluid into the annulus 216 of the wellbore 214. The downhole tool 218 may operate in the continuous pumping mode until the formation fluid flowing through the flowline 238 is determined to be clean enough for sampling. That is, when the formation fluid is first obtained from the subsurface formation 212, OBM filtrate that has been forced into the subsurface formation 212 via the drilling operations may enter the downhole tool 218 along with the obtained formation fluid. After pumping the formation fluid for an amount of time, the formation fluid flowing through the downhole tool 218 will provide a cleaner fluid sample of the subsurface formation 212 than would otherwise be available when first drawing fluid in through the probe 232. For example, the formation fluid may be considered clean when the OD data from the spectrometer 240 indicates that the formation fluid contains less than approximately 1%, 5%, or 10% OBM filtrate contamination (by volume), although other values are also within the scope of the present disclosure.

Figure 3:
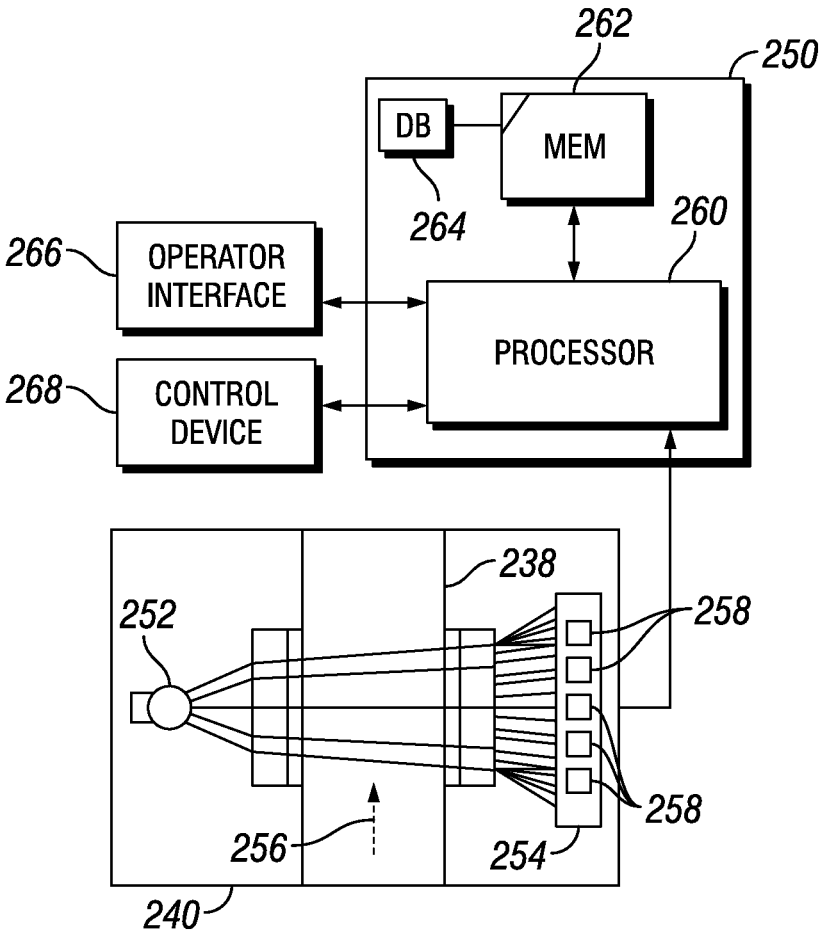
FIG. 3 is a schematic view of at least a portion of an example implementation of apparatus according to one or more aspects of the present disclosure.

The characteristics of the formation fluid measured by the spectrometer 240 may be useful for performing a variety of evaluation and control functions, in addition to determining when the formation fluid flowing through the flowline 238 is clean enough for sampling. For example, data may be collected from the spectrometer 240 and/or other sensors within the downhole tool, such as a density sensor, a viscosity sensor, a pressure sensor, a temperature sensor, and/or a saturation pressure sensor, among others. The collected data may be utilized to estimate a formation volume factor (FVF) of the contaminated formation fluid, as well as density, OD, gas-oil ratio (GOR), compressibility, saturation pressure, viscosity, and/or mass fractions of compositional components of the contaminated formation fluid and/or contaminants therein (e.g., OBM filtrate), among others. The collected data may also be utilized to determine, estimate, or otherwise obtain a dependence of OD and/or FVF on downhole pressure FIG. 3 is a schematic diagram of the spectrometer 240 and a control/monitoring system 250 that may be utilized to estimate or determine one or more of such properties. The spectrometer 240 may comprise a light source 252 and a detector 254 disposed on opposite sides of the flowline 238 through which the formation fluid flows, as indicated by arrow 256. The spectrometer 240 may be part of the downhole tool 218, and may be located at various possible locations along the flowline 238 that directs the formation fluid through the downhole tool 218. Although a single light source 252 is depicted in the example shown in FIG. 3, the spectrometer 240 may include additional light sources 252. The detector 254 may sense the light that passes through the formation fluid in the flowline 238.

The detector 254 may include one or more detector elements 258 that may each be operable to measure the amount of light transmitted at a predetermined wavelength. For example, the detector elements 258 may detect the light transmitted from the visible to near-infrared within a range of 1, 5, 10, 20, or more different wavelengths ranging between about 400 nm and about 2500 nm. However, other numbers of wavelengths (corresponding to the number of detector elements) and other ranges of wavelengths are also within the scope of the present disclosure. For example, optical characteristics of the formation fluid may be detected at a range of wavelengths, such as the near infrared (NIR) wavelength range of approximately 400-2500 nm, 1500-2050 nm, or 1600-1800 nm. Estimations of formation fluid properties according to one or more aspects of the present disclosure may utilize optical data collected at a single wavelength, at multiple wavelengths, at a range of wavelengths, or at multiple wavelength ranges.

The spectrometer 240 may measure one or more optical characteristics of the formation fluid flowing through the flowline 238 and output optical spectra and/or other data representative of the detected optical characteristics. The optical characteristics may include OD of the formation fluid at each of the detected wavelengths or wavelength ranges. The OD is a logarithmic measurement relating the intensity of light emitted from the light source 252 to the intensity of light detected by the detector 254 at a predetermined wavelength or wavelength range. Each wavelength or range may correspond to a compositional component of the formation fluid. For example, each wavelength, wavelength range, or combination of wavelengths/ranges may pertain to a corresponding one of carbon dioxide $CO_2$, hydrocarbon C1, hydrocarbon C2, hydrocarbon C3, hydrocarbon C4, hydrocarbon C5, and hydrocarbons C6+, or other compositional components; although other arrangements are also within the scope of the present disclosure.

The spectrometer 240 may send optical spectra and/or other data representative of the measured optical characteristics to a processor 260 of the control/monitoring system 250. In the context of the present disclosure, the term "processor" refers to any number of processor components. The processor 260 may include a single processor disposed onboard the downhole tool 218. In other implementations, at least a portion of the processor 260 (e.g., where multiple processors collectively operate as the processor 260) may be located within the wellsite surface equipment 224 of FIG. 2, the logging and control unit 144 of FIG. 1, and/or other surface equipment components. The processor 260 may also or instead be or include one or more processors located within the downhole tool 218 and connected to one or more processors located in drilling and/or other equipment disposed at the wellsite surface 116. Moreover, various combinations of processors may be considered part of the processor 260 in the following description. Similar terminology is applied with respect to the control/monitoring system 250, as well as a memory 262 of the control/monitoring system 250, meaning that the control/monitoring system 250 may include various processors communicatively coupled to each other and/or various memories at various locations.

The control/monitoring system 250 may estimate the FVF, GOR, and/or other parameters of the formation fluid based on the OD data received from the spectrometer 240, a density sensor, a pressure sensor, a temperature sensor, and/or other sensors, and may utilize the estimated FVF, GOR, and/or other parameters of the formation fluid to determine density, weight fractions of compositional components, OBM filtrate contamination, and/or other properties of the formation fluid. To make these and other determinations, the processor 260 may execute instructions stored in the memory 262.

The processor 260 may be communicatively coupled with one or more operator interfaces 266 and/or control devices 268. The operator interface 266 may include logs of predicted formation fluid properties that are accessible to an operator. The control device 268 may include one or more devices and/or portions thereof that receive control signals for operation based on the estimated properties of the formation fluid. Such control devices 268 may implement changes in depth of the downhole tool 218 within the wellbore 126, adjustments to the pumping pressure and/or rate of the pump 236, and/or other control functions, perhaps based on obtained, calculated, and/or estimated formation fluid properties.

One or more functions and/or other aspects of the downhole tool 218 may also be applicable or readily adaptable to at least a portion of the downhole apparatus shown in FIG. 1. For example, one or more of the SWD tools, LWD modules 140, and/or MWD modules 142 shown in FIG. 1 and/or described above may have one or more functions and/or other aspects in common with a corresponding portion(s) of the downhole tool 218 shown in FIGS. 2 and 3.

Figure 4:
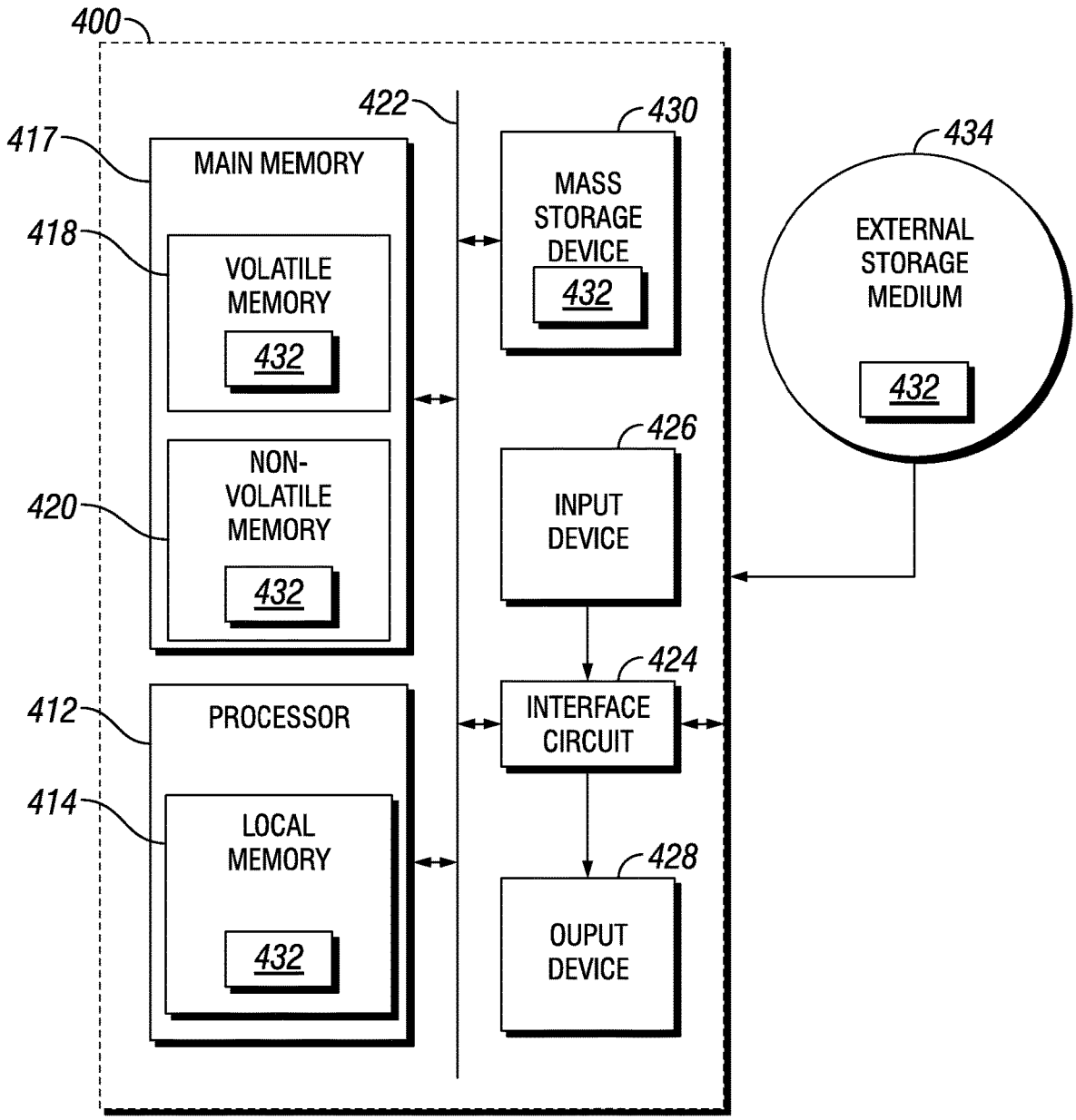
FIG. 4 is a schematic view of at least a portion of an example implementation of apparatus according to one or more aspects of the present disclosure.

FIG. 4 is a schematic view of at least a portion of an example implementation of a processing system 400 according to one or more aspects of the present disclosure. The processing system 400 may execute example machine-readable instructions to implement at least a portion of one or more of the methods and/or processes described herein, and/or to implement a portion of one or more of the example downhole tools described herein.

The processing system 400 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the processing system 400 shown in FIG. 4 is implemented within a downhole tool, such as the downhole tools and/or modules shown in one or more of FIGS. 1-3, one or more components or functions of the processing system 400 may also or instead be implemented in wellsite surface equipment, perhaps including the logging and control unit 144 and/or other wellsite surface equipment depicted in FIG. 1 and/or the wellsite surface equipment 224 shown in FIG. 2.

The processing system 400 comprises a processor 412 such as, for example, a general-purpose programmable processor. The processor 412 may comprise a local memory 414, and may execute program code instructions 432 present in the local memory 414 and/or in another memory device. The processor 412 may execute, among other things, machine-readable instructions or programs to implement the methods and/or processes described herein. The programs stored in the local memory 414 may include program instructions or computer program code that, when executed by an associated processor, enable surface equipment and/or a downhole tool to perform tasks as described herein. The processor 412 may be, comprise, or be implemented by one or more processors of various types operable in the local application environment, and may include one or more general purpose processors, special-purpose processors, microprocessors, digital signal processors (DSPs), field-programmable gate arrays (FPGAs), application-specific integrated circuits (ASICs), processors based on a multi-core processor architecture, and/or other processors. More particularly, examples of a processor 412 include one or more INTEL microprocessors, microcontrollers from the ARM and/or PICO families of microcontrollers, embedded soft/hard processors in one or more FPGAs, etc.

The processor 412 may be in communication with a main memory 417, such as via a bus 422 and/or other communication means. The main memory 417 may comprise a volatile memory 418 and a non-volatile memory 420. The volatile memory 418 may be, comprise, or be implemented by tangible, non-transitory storage medium, such as random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by tangible, non-transitory storage medium, such as read-only memory, flash memory and/or other types of memory devices. One or more memory controllers (not shown) may control access to the volatile memory 418 and/or the non-volatile memory 420.

The processing system 400 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 424 may also comprise a graphics driver card. The interface circuit 424 may also comprise a communication device such as a modem or network interface card to facilitate exchange of data with external computing devices via a network, such as via Ethernet connection, digital subscriber line (DSL), telephone line, coaxial cable, cellular telephone system, and/or satellite, among other examples.

One or more input devices 426 may be connected to the interface circuit 424. One or more of the input devices 426 may permit a user to enter data and/or commands for utilization by the processor 412. Each input device 426 may be, comprise, or be implemented by a keyboard, a mouse, a touchscreen, a track-pad, a trackball, an image/code scanner, and/or a voice recognition system, among other examples.

One or more output devices 428 may also be connected to the interface circuit 424. One or more of the output device 428 may be, comprise, or be implemented by a display device, such as a liquid crystal display (LCD), a light-emitting diode (LED) display, and/or a cathode ray tube (CRT) display, among other examples. One or more of the output devices 428 may also or instead be, comprise, or be implemented by a printer, speaker, and/or other examples.

The processing system 400 may also comprise a mass storage device 430 for storing machine-readable instructions and data. The mass storage device 430 may be connected to the interface circuit 424, such as via the bus 422. The mass storage device 430 may be or comprise tangible, non-transitory storage medium, such as a floppy disk drive, a hard disk drive, a compact disk (CD) drive, and/or digital versatile disk (DVD) drive, among other examples. The program code instructions 432 may be stored in the mass storage device 430, the volatile memory 418, the non-volatile memory 420, the local memory 414, and/or on a removable storage medium, such as a CD or DVD.

The modules and/or other components of the processing system 400 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The following methods or processes may allow for prediction of a composition of a fluid and/or a phase behavior of the fluid. The methods or processes are described in the context of devices and components described above, although in other implementations also within the scope of the present disclosure, methods or processes within the scope of this disclosure may be performed in the context of other devices and components. The methods or processes described below are presented in a given order, although other implementations also within the scope of the present disclosure may comprise the described and/or other methods or processes in other orders and/or in parallel. Various other modifications to the methods or processes described below may also be consistent with the scope of the present disclosure. For example, such implementations may include additional or fewer calculations, determinations, computations, logic, monitoring, and/or other aspects.

An expected composition of the fluid and/or an expected phase behavior of the fluid may be determined during in situ fluid analysis. The following description relates to methods and/or processes for determining an expected composition and/or phase behavior of the fluid. Properties of the fluid may be obtained during the fluid analysis. Using a trained machine learning algorithm, one or more expected properties of the fluid may be inferred to obtain, for example, an expected composition of the fluid. One or more uncertainties that may arise from obtaining the expected properties may be propagated to obtain one or more uncertainties of the expected properties. Using the expected properties and the uncertainty of the expected properties, an expected behavior, such as a phase envelope, of the fluid and a deviation behavior of the fluid may be generated.

Figure 5:
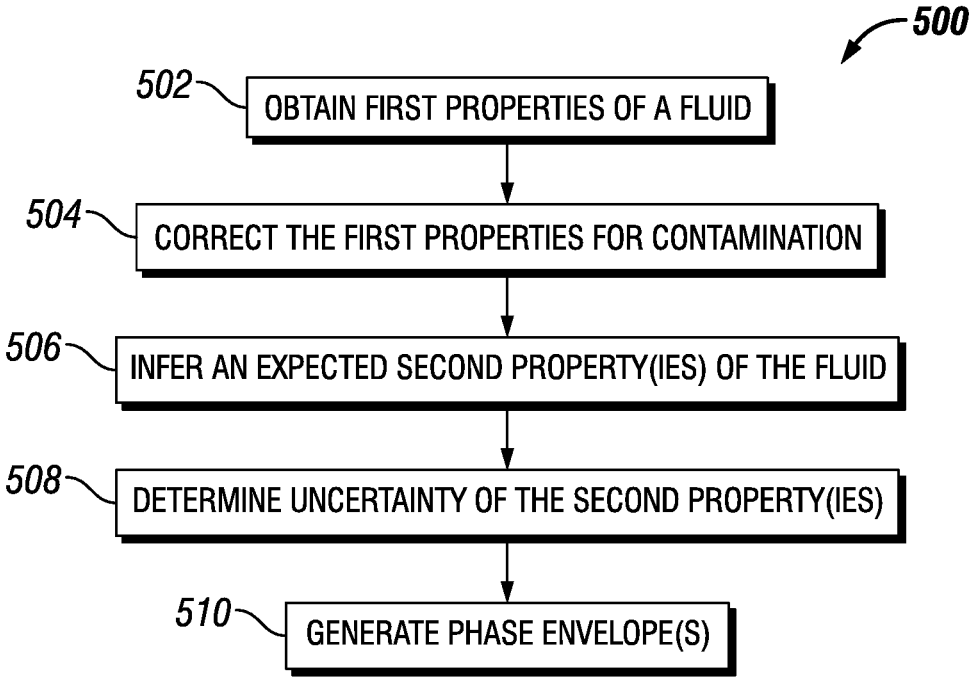
FIG. 5 is a flow-chart diagram of at least a portion of an example implementation of a method according to one or more aspects of the present disclosure.

FIG. 5 is a flow-chart diagram of at least a portion of an example implementation of a method (500) for determining an expected composition and/or phase behavior of a fluid according to one or more aspects of the present disclosure. The method (500) may be performed at a wellsite, such as illustrated in FIGS. 1 and 2, and may be performed by a processing system, such as illustrated in FIGS. 3 and 4. The method (500) may be used to obtain in situ, real-time data associated with a fluid obtained by a downhole sampling tool disposed in a wellbore that extends into a subterranean formation.

As described with respect to foregoing figures, a sampling tool is conveyed into a wellbore and begins a fluid sampling process by engaging the sampling tool to a reservoir. The sampling tool can then begin to pump fluid from the reservoir into and through the sampling tool. A cleanup process may be performed to obtain fluid with low levels of, for example, OBM contamination, using monitoring (e.g., OBM contamination monitoring (OCM)) of the optical density, density space, and compositional space of the fluid flowing in the sampling tool. An OCM process may be performed as described in U.S. patent application Ser. No. 14/697,382, filed on Apr. 27, 2015, entitled "Downhole Real-Time Filtrate Contamination Monitoring," the entire disclosure of which is hereby incorporated herein. The OCM process may quantify an amount of contamination of the fluid that will be the subject of the sampling.

The method (500) may include obtaining (502) first properties of the fluid. In some example implementations, the first properties can include OD, mass density, viscosity, composition (e.g., by weight fractions), GOR, etc. Additionally, in some example implementations, the first properties may be obtained from sensors in the sampling tool, such as previously described.

The first properties are corrected (504) for contamination using a contamination correction method to account for an amount of contamination of the fluid that is the subject of the sampling. Some example contamination correction methods are described in U.S. Pat. No. 8,805,617, issued Aug. 12, 2014 to Zuo et al., and entitled "Methods and Apparatus for Characterization of Petroleum Fluids Contaminated with Drilling Mud" and in U.S. Pat. No. 7,920,970, issued Apr. 5, 2011 to Zuo et al., and entitled "Methods and Apparatus for Characterization of Petroleum Fluid and Applications Thereof"; both of these disclosures are incorporated herein by reference in their entireties.

The corrected first properties are used to infer (506) one or more expected second properties of the fluid. In some example implementations, a machine learning algorithm, such as an Artificial Neural Network (ANN), a multivariate regression algorithm, a Support Vector Machine (SVM), or the like, can be used to infer the expected second property. For example, the machine learning algorithm may be trained using a number of historical samples of fluids. The machine learning algorithm may be trained to have the corrected first properties input and to output one or more expected second properties based on the training from the historical samples. As an example detailed further herein with respect to following figures, compositional component weight fractions of a petroleum fluid can be inputs to the machine learning algorithm, and an expected mole fraction of one or more compositional component of the petroleum fluid can be output from the machine learning algorithm. Using this expected mole fraction of the one or more compositional component, another expected mole fraction(s) of one or more other compositional components can be generated to obtain an expected composition of the petroleum fluid based on the expected compositional component mole fractions. Additional or different inputs and outputs can be used with a machine learning algorithm according to other aspects of the disclosure.

The method (500) may comprise determining (508) one or more uncertainties of the one or more expected second properties. Various uncertainties may occur during the generation of the expected second property. For example, a sensor for detecting one of the first properties can have an uncertainty based on physical constraints of the sensor. Additionally, the contamination correction process can introduce some uncertainty to the expected second property. Further, the inference of the expected second property using a machine learning algorithm can introduce uncertainty to the second property. These uncertainties can be propagated to the second property using a propagation of uncertainty technique. Continuing the example from above, the expected mole fractions of the compositional components of the petroleum fluid can each have a corresponding uncertainty that is obtained using a propagation of uncertainty technique.

The method may further comprise generating (510) one or more phase envelopes of the fluid based on the one or more expected second properties and the one or more uncertainties. A thermodynamic fluid model may be used to generate a phase envelope. For example, an equation of state (EoS), such as a calibrated cubic EoS, may be used to generate a phase envelope. In some example implementations, an expected phase envelope can be generated using the expected composition, and additional phase envelopes can be generated using the one or more uncertainties. The additional phase envelopes can define a deviation region in which the actual phase envelope of the fluid, based on the actual one or more properties corresponding to the one or more second properties, is expected to reside based on, e.g., a standard deviation from what is expected.

Using the one or more phase envelopes, some physical characteristics of the fluid may be extracted, such as bubble point pressure, dew point pressure, Asphaltene Onset Pressure (AOP), or the like. Using the extracted physical characteristics, an operator may have information to determine an appropriate course of action at the wellsite, and this information may be used to determine whether to continue operations as planned, deviate from the plan, acquire additional measurements, repeat a sampling process, etc.

The following figures and description illustrate example implementations in the context of sampling a petroleum formation fluid, such as oil or gas. Generally speaking, an oil-type machine learning algorithm and a gas-type machine learning algorithm are trained based on historical samples of oil and gas, respectively, using normalized compositional component weight fractions and mole fractions obtained from fluid sampling. The machine learning algorithms are trained to have the compositional component weight fractions input and to output an expected hydrocarbons C6+ mole fraction. During fluid sampling, one of the oil-type and gas-type machine learning algorithms are selected based on the type of fluid being sampled, and the compositional component weight fractions are input to the selected machine learning algorithm. The selected machine learning algorithm outputs the expected hydrocarbons C6+ mole fraction, and using this expected mole fraction, an expected hydrocarbons C6+ molar mass is calculated. With the expected hydrocarbons C6+ mole fraction and expected hydrocarbons C6+ molar mass, other expected compositional component (e.g., $CO_2$, C1, C2, C3, C4, and C5) mole fractions can be calculated. In other example implementations, the machine learning algorithms are trained to have the compositional component weight fractions input and to output expected mole fractions of multiple compositional components (e.g., $CO_2$, C1, C2, C3, C4, C5 and C6+).

Further, generally speaking, uncertainties for the compositional components (e.g., $CO_2$, C1, C2, C3, C4, C5, and C6+) that arise from the generation of the expected compositional component mole fractions are propagated to the corresponding compositional component mole fractions. Using an EoS and the expected composition (e.g., the expected compositional component mole fractions), an expected phase envelope can be generated. Additionally, using the uncertainties, a deviation region defined by deviation phase envelopes can be determined. With these phase envelopes and the deviation region, an operator may have real-time information to make an operation decision. Although examples described herein reference $CO_2$, C1, C2, C3, C4, C5, and C6+ compositional components, other compositional components, such as hydrogen sulfide $H_2S$, nitrogen $N_2$, and others, may be used with or instead of any other compositional component(s).

Figure 6:
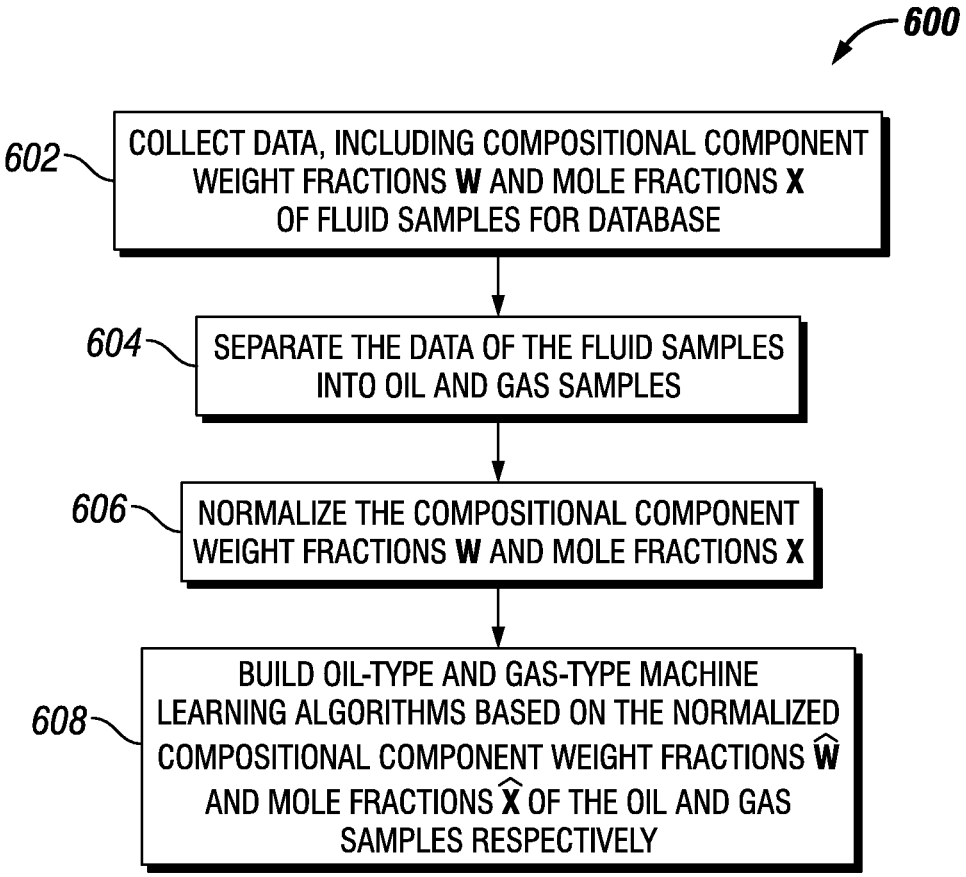
FIG. 6 is a flow-chart diagram of at least a portion of an example implementation of a method according to one or more aspects of the present disclosure.

FIG. 6 is a flow-chart diagram of at least a portion of an example implementation of a method (600) for building a machine learning algorithm that is used in the inferring (506) the second property depicted in FIG. 5. The method (600) may be performed by a processing system, such as illustrated in FIG. 4 and may be performed at or remote from a wellsite location.

The method (600) comprises collecting (602) data relating to a plurality of fluid samples to input into a database. The data includes compositional component weight fractions W and mole fractions X. The data is of fluid samples acquired over a previous period of time and may be referred to as historical samples. The historical samples may have a broad range of oil types, such as including condensate to heavy oil. The weight fractions W may be organized in a vector for a corresponding fluid sample, as shown in Equation (1) below. Similarly, the mole fractions X may be organized in a vector for a corresponding fluid sample, as shown in Equation (2) below. In the equations below, and in subsequent description, a subscript "0" indicates a variable corresponding to carbon dioxide $CO_2$; a subscript "1" indicates a variable corresponding to hydrocarbon C1; a subscript "2" indicates a variable corresponding to hydrocarbon C2; a subscript "3" indicates a variable corresponding to hydrocarbon C3; a subscript "4" indicates a variable corresponding to hydrocarbon C4; a subscript "5" indicates a variable corresponding to hydrocarbon C5; a subscript "6" indicates a variable corresponding to hydrocarbons C6+. In other example implementations, other compositional components may be included or used instead, such as hydrogen sulfide $H_2S$, nitrogen $N_2$, and/or other example compositional components.

$$W=[w_0,w_1,w_2,w_3,w_4,w_5,w_6]^T \quad \text{Eq. (1)}$$

$$X=[x_0,x_1,x_2,x_3,x_4,x_5,x_6]^T \quad \text{Eq. (2)}$$

The data of the fluid samples is separated (604) into oil samples and gas samples. The data of the fluid samples can be separated based on an applicable criterion, such as a GOR, a mass ratio of a mass of hydrocarbon C1 to a mass of hydrocarbons C6+, or another. When a GOR is used as a criterion, a GOR less than 570 $m^3/m^3$ may indicate an oil sample, and a GOR greater than 570 $m^3/m^3$ may indicate a gas sample. It is worth noting that 570 $m^3/m^3$ is provided as an example, and other demarcations may be used. When a mass ratio of hydrocarbon C1 to hydrocarbons C6+ is used, a mass ratio less than 0.5 may indicate an oil sample, and a mass ratio greater than 0.5 may indicate a gas sample. Other demarcations for a mass ratio may be used. In some example implementations, statistical outliers from the groups of samples may be removed.

The compositional component weight fractions W and mole fractions X are normalized (606). For any given fluid sample, the compositional component weight fractions W and mole fractions X can be normalized to obtain normalized weight fractions $\hat{W}$ and mole fractions $\hat{X}$ as follows in Equations (3) through (6).

$$\hat{w}_i = \frac{w_i}{\sum_{n=0}^{6} w_n} \quad \text{Eq. (3)}$$

$$\hat{W} = \begin{bmatrix} \hat{w}_0 \\ \hat{w}_1 \\ \hat{w}_2 \\ \hat{w}_3 \\ \hat{w}_4 \\ \hat{w}_5 \\ \hat{w}_6 \end{bmatrix} \quad \text{Eq. (4)}$$

$$\hat{x}_i = \frac{x_i}{\sum_{n=0}^{6} x_n} \quad \text{Eq. (5)}$$

$$\hat{X} = \begin{bmatrix} \hat{x}_0 \\ \hat{x}_1 \\ \hat{x}_2 \\ \hat{x}_3 \\ \hat{x}_4 \\ \hat{x}_5 \\ \hat{x}_6 \end{bmatrix} \quad \text{Eq. (6)}$$

This normalization may be omitted if the compositional component weight fractions W and mole fractions X are or previously were normalized, for example.

An oil-type machine learning algorithm is built (608) based on the normalized compositional component weight fractions $\hat{W}$ and mole fractions $\hat{X}$ of the oil samples, and a gas-type machine learning algorithm is built (608) based on the normalized compositional component weight fractions $\hat{W}$ and mole fractions $\hat{X}$ of the gas samples. The machine learning algorithms may be an ANN, a multivariate regression algorithm, an SVM, or the like. The machine learning algorithm may be trained to have as inputs the compositional component weight fractions W and to output an expected hydrocarbons C6+ mole fraction $x_6$ and/or to output respective expected mole fractions of multiple compositional components (e.g., $CO_2$, C1, C2, C3, C4, C5, and C6+). In other example implementations, different inputs, such as live density, among others, may be used in the place of or to supplement the compositional component weight fractions W, and different outputs may be used.

In some example implementations, some of the data of the oil historical samples and the gas historical samples may be used to validate the oil-type machine learning algorithm and the gas-type machine learning algorithm. For example, of a dataset of 1,800 samples that are separated into oil samples and gas samples, eighty percent (80%) of the grouped samples can be used to train the respective machine learning algorithms, and the remaining twenty percent (20%) of the grouped samples can be used to validate the respective machine learning algorithms.

Figure 7:
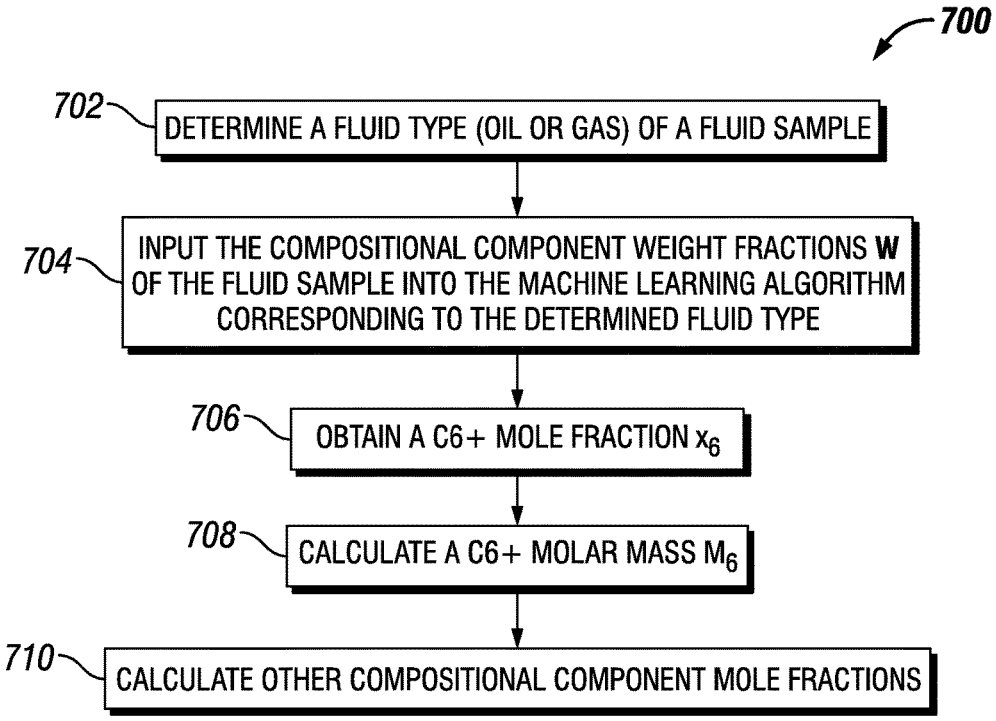
FIG. 7 is a flow-chart diagram of at least a portion of an example implementation of a method according to one or more aspects of the present disclosure.

FIG. 7 is a flow-chart diagram of at least a portion of an example implementation of a method (700) for determining expected compositional component mole fractions of a fluid, as described above with respect to the inferring (506) the second property depicted in FIG. 5. The method (700) may be performed by a processing system, such as illustrated in FIGS. 3 and 4 and may be performed at a wellsite location, for example. The method (700) may be performed in conjunction with fluid sampling using a downhole fluid sampling tool to obtain in situ, real-time information to inform operation decisions.

A fluid type of the fluid sample is determined (702). The fluid type in this example implementation may be oil or gas. The determination can be based on an applicable criterion, such as a GOR, a mass ratio of a mass of hydrocarbon C1 to a mass of hydrocarbons C6+, or another. When a GOR is used as a criterion, a GOR less than 570 $m^3/m^3$ may indicate an oil sample, and a GOR greater than 570 $m^3/m^3$ may indicate a gas sample. It is worth noting that 570 $m^3/m^3$ is provided as an example, and other demarcations may be used. When a mass ratio of hydrocarbon C1 to hydrocarbons C6+ is used, a mass ratio less than 0.5 may indicate an oil sample, and a mass ratio greater than 0.5 may indicate a gas sample. Other demarcations for a mass ratio may be used. This determination is used to select which machine learning algorithm will be used, as described below.

The method (700) includes inputting (704) compositional component weight fractions W of the fluid sample into the machine learning algorithm corresponding to the determined fluid type of the fluid sample. If the fluid type is determined (702) to be oil, the compositional component weight fractions W are input into the oil-type machine learning algorithm, and if the fluid type is determined (702) to be gas, the compositional component weight fractions W are input into the gas-type machine learning algorithm.

An expected hydrocarbons C6+ mole fraction $x_6$ is obtained (706) from the machine learning algorithm into which the compositional component weight fractions W are input (704). With the training of the machine learning algorithm as described above in the method (600) of FIG. 6, an expected hydrocarbons C6+ mole fraction $x_6$ is output based on an analysis of the compositional component weight fractions W that are input to the machine learning algorithm. In some instances, since the analysis is statistical in nature, unreasonable outliers may be output from the machine learning algorithm, and hence, the expected hydrocarbons C6+ mole fraction $x_6$ that is output may be truncated within a range of zero (0) to one (1).

An expected hydrocarbons C6+ molar mass $M_6$ is calculated (708) using the expected hydrocarbons C6+ mole fraction $x_6$. Since carbon dioxide $CO_2$ and the hydrocarbons C1, C2, C3, C4, and C5 are relatively defined molecules, their respective molar masses (e.g., $M_0$, $M_1$, $M_2$, $M_3$, $M_4$, and $M_5$) are known. Additionally, the compositional component weight fractions W (e.g., $w_0$, $w_1$, $w_2$, $w_3$, $w_4$, $w_5$, and $w_6$) are obtained through fluid sampling as described above. The expected hydrocarbons C6+ molar mass $M_6$ of any given sampled fluid is a variable since hydrocarbons C6+ include many possible different types of molecules, and with the foregoing information being known or obtained, the expected hydrocarbons C6+ molar mass $M_6$ may be calculated as shown in Equation (7) below.

$$M_6 = \frac{w_6\left(\frac{1}{x_6} - 1\right)}{\sum_{j=0}^{5} \frac{w_j}{M_j}} \quad \text{Eq. (7)}$$

Other expected compositional component mole fractions are calculated (710) using the expected hydrocarbons C6+ molar mass $M_6$ and the expected hydrocarbons C6+ mole fraction $x_6$. The other expected compositional component mole fractions $x_0$, $x_1$, $x_2$, $x_3$, $x_4$, and $x_5$ corresponding to $CO_2$, C1, C2, C3, C4, and C5, respectively, can be calculated as shown in Equation (8) below.

$$x_i = \frac{\frac{w_i}{M_i}}{\sum_{j=0}^{6} \frac{w_j}{M_j}}, \text{ where } i = 0, 1, \ldots 5 \quad \text{Eq. (8)}$$

In other example implementations, other compositional components may be included or used instead, such as hydrogen sulfide $H_2S$, nitrogen $N_2$, and/or other example compositional components.

In other example implementations, calculating (708) the expected hydrocarbons C6+ molar mass $M_6$ and calculating (710) the other expected compositional component mole fractions can be omitted, for example, when the machine learning algorithm is trained to output the other expected compositional component mole fractions (e.g., for $CO_2$, C1, C2, C3, C4, and C5) when the expected hydrocarbons C6+ mole fraction $x_6$ is obtained (706).

Figure 8:
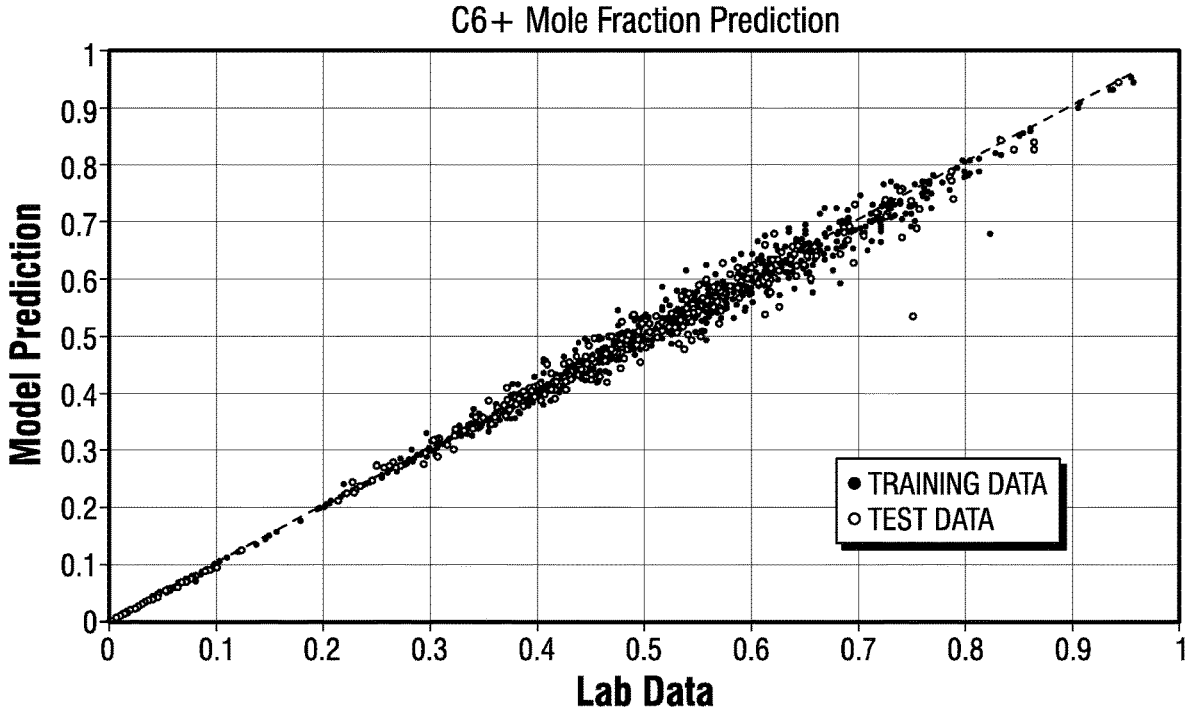
FIG. 8 is a graph depicting one or more aspects of an example implementation according to one or more aspects of the present disclosure.
Figure 9:
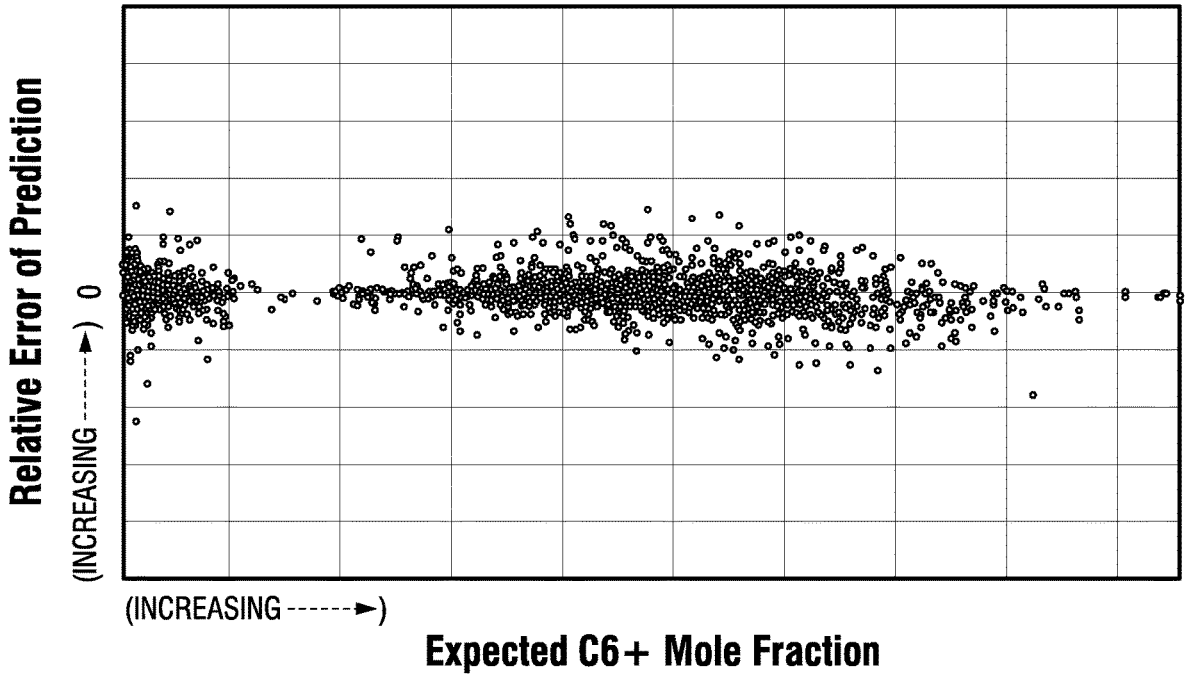
FIG. 9 is a graph depicting one or more aspects of an example implementation according to one or more aspects of the present disclosure.
Figure 10:
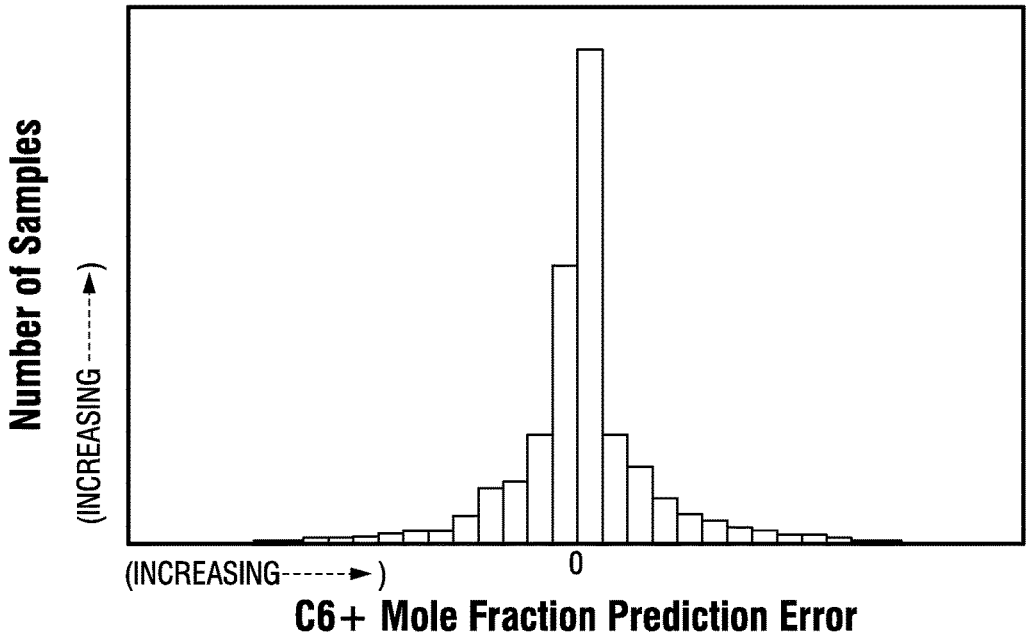
FIG. 10 is a graph depicting one or more aspects of an example implementation according to one or more aspects of the present disclosure.

FIG. 8 is a graph showing training data used to train a SVM and test data generated by the SVM for predicting an expected hydrocarbons C6+ mole fraction $x_6$ from an experiment implementing one or more aspects of the present disclosure. The graph of FIG. 8 shows that the test data caused respective predictions near the line having a slope of one (1), e.g., the expected (e.g., predicted) hydrocarbons C6+ mole fraction $x_6$ closely approximated the lab tested hydrocarbons C6+ mole fraction $x_6$. FIG. 9 is a graph showing a relative error of predicted hydrocarbons C6+ mole fraction $x_6$ generated by the SVM from an experiment implementing one or more aspects of the present disclosure. The relative error was calculated as a ratio of a difference between the predicted hydrocarbons C6+ mole fraction $x_6$ and the actual lab tested hydrocarbons C6+ mole fraction $x_6$ to the actual lab tested hydrocarbons C6+ mole fraction $x_6$ (e.g., (predict−actual)/actual). FIG. 10 is a histogram showing collective number of samples for given deviations of the predicted hydrocarbons C6+ mole fraction $x_6$ generated by the SVM from the actual lab tested hydrocarbons C6+ mole fraction $x_6$ from an experiment implementing one or more aspects of the present disclosure. In this experiment, ninety percent (90%) of the SVM predicted hydrocarbons C6+ mole fraction data are within 2.6% uncertainty.

Figure 11:
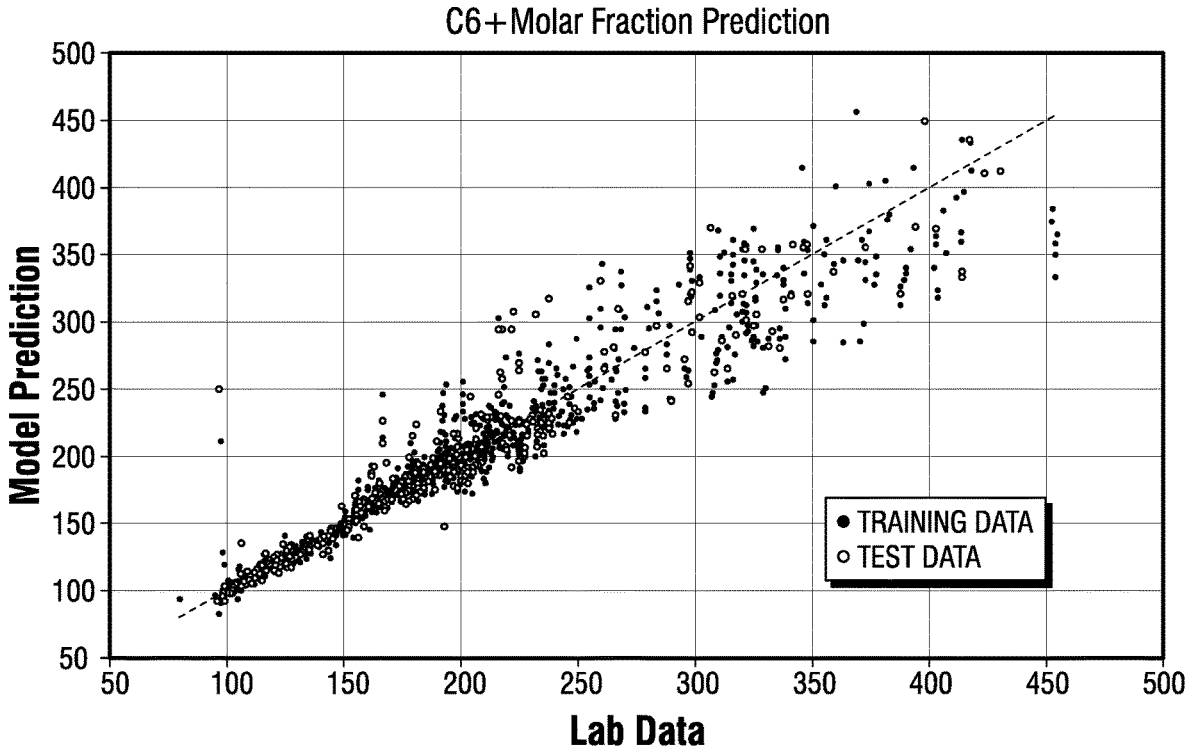
FIG. 11 is a graph depicting one or more aspects of an example implementation according to one or more aspects of the present disclosure.
Figure 12:
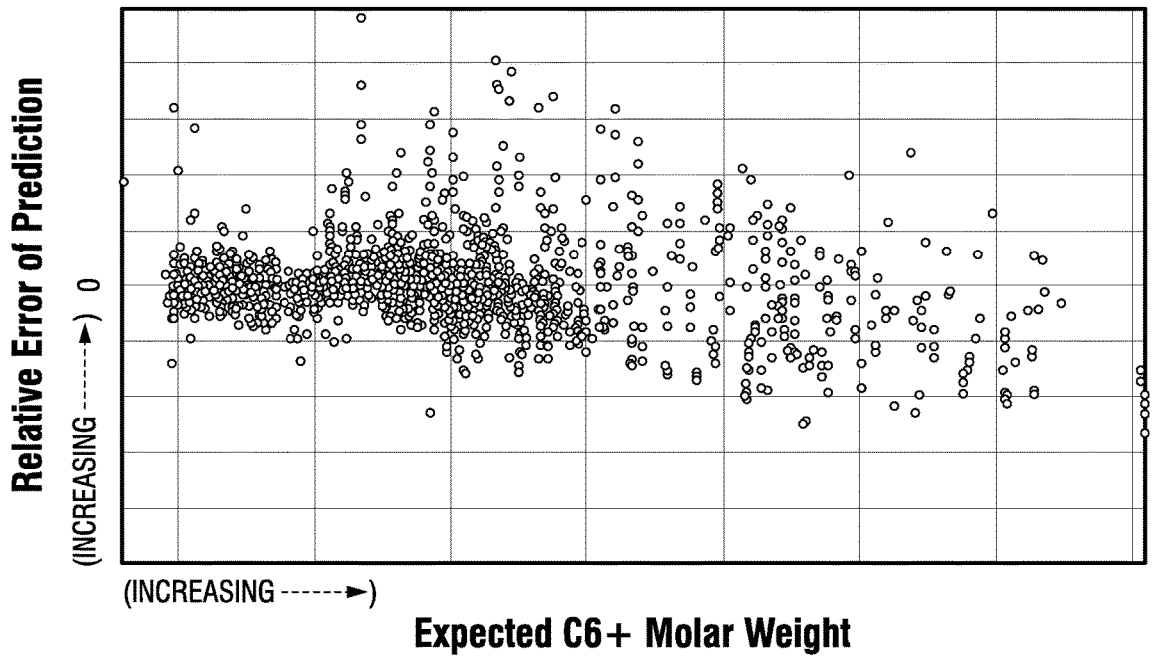
FIG. 12 is a graph depicting one or more aspects of an example implementation according to one or more aspects of the present disclosure.
Figure 13:
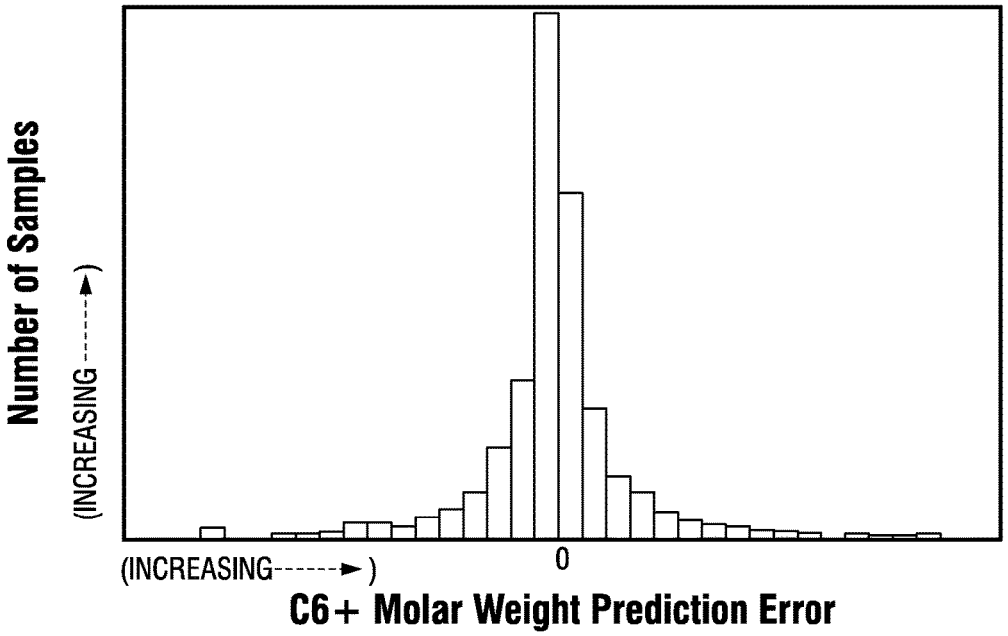
FIG. 13 is a graph depicting one or more aspects of an example implementation according to one or more aspects of the present disclosure.

FIG. 11 is a graph showing training data used to train a SVM and test data generated for predicting an expected hydrocarbons C6+ molar mass $M_6$ from an experiment implementing one or more aspects of the present disclosure. The graph of FIG. 11 shows that the test data caused respective predictions near the line having a slope of one (1), e.g., the predicted hydrocarbons C6+ molar mass $M_6$ closely approximated the lab tested hydrocarbons C6+ molar mass $M_6$. FIG. 12 is a graph showing a relative error of predicted hydrocarbons C6+ molar mass $M_6$ from an experiment implementing one or more aspects of the present disclosure. The relative error was calculated as a ratio of a difference between the predicted hydrocarbons C6+ molar mass $M_6$ and the actual lab tested hydrocarbons C6+ molar mass $M_6$ to the actual lab tested hydrocarbons C6+ molar mass $M_6$ (e.g., (predict−actual)/actual). FIG. 13 is a histogram showing collective number of samples for given deviations of the predicted hydrocarbons C6+ molar mass $M_6$ from the actual lab tested hydrocarbons C6+ molar mass $M_6$ from an experiment implementing one or more aspects of the present disclosure.

Figure 14:
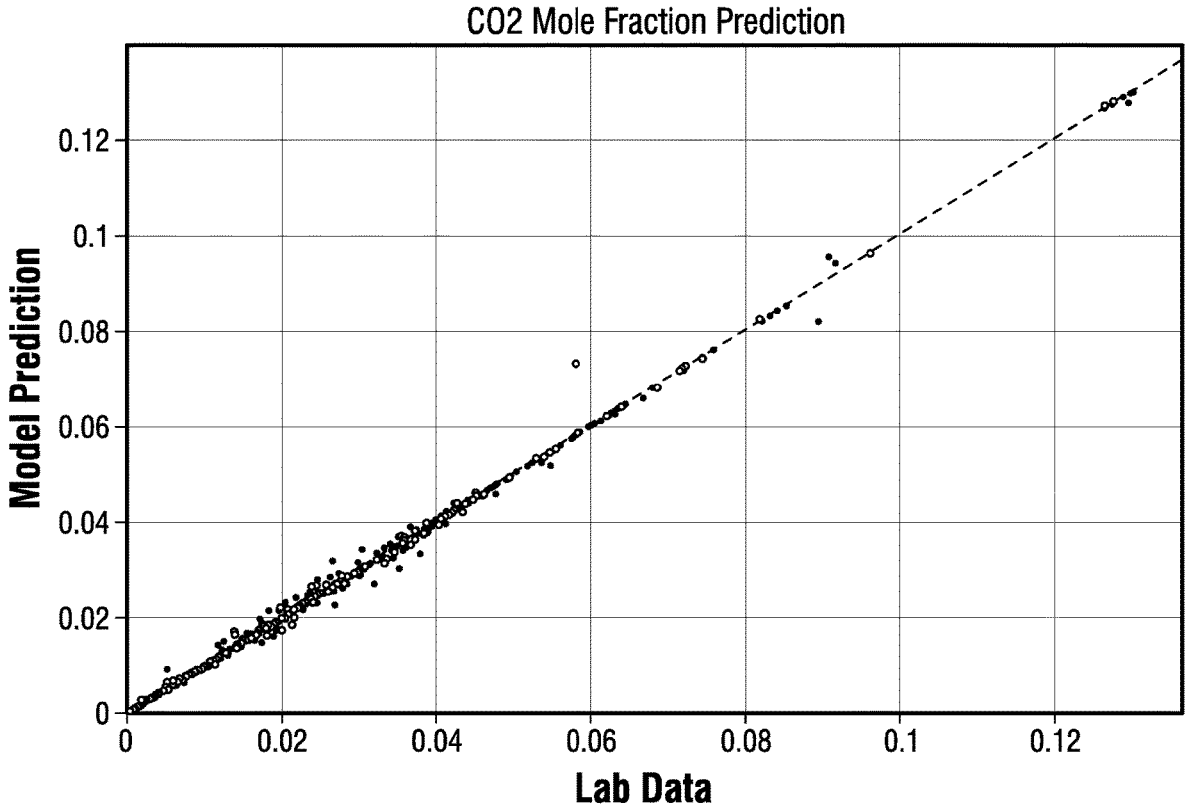
FIG. 14 is a graph depicting one or more aspects of an example implementation according to one or more aspects of the present disclosure.
Figure 15:
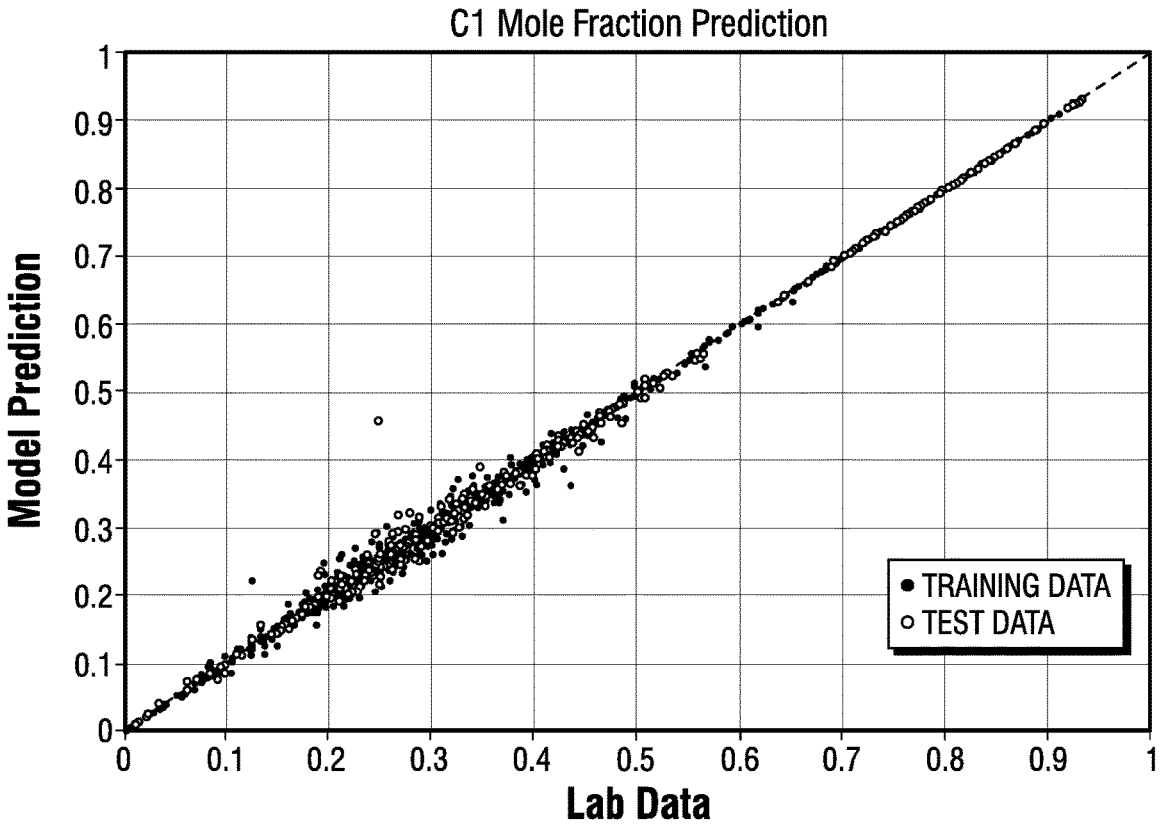
FIG. 15 is a graph depicting one or more aspects of an example implementation according to one or more aspects of the present disclosure.
Figure 16:
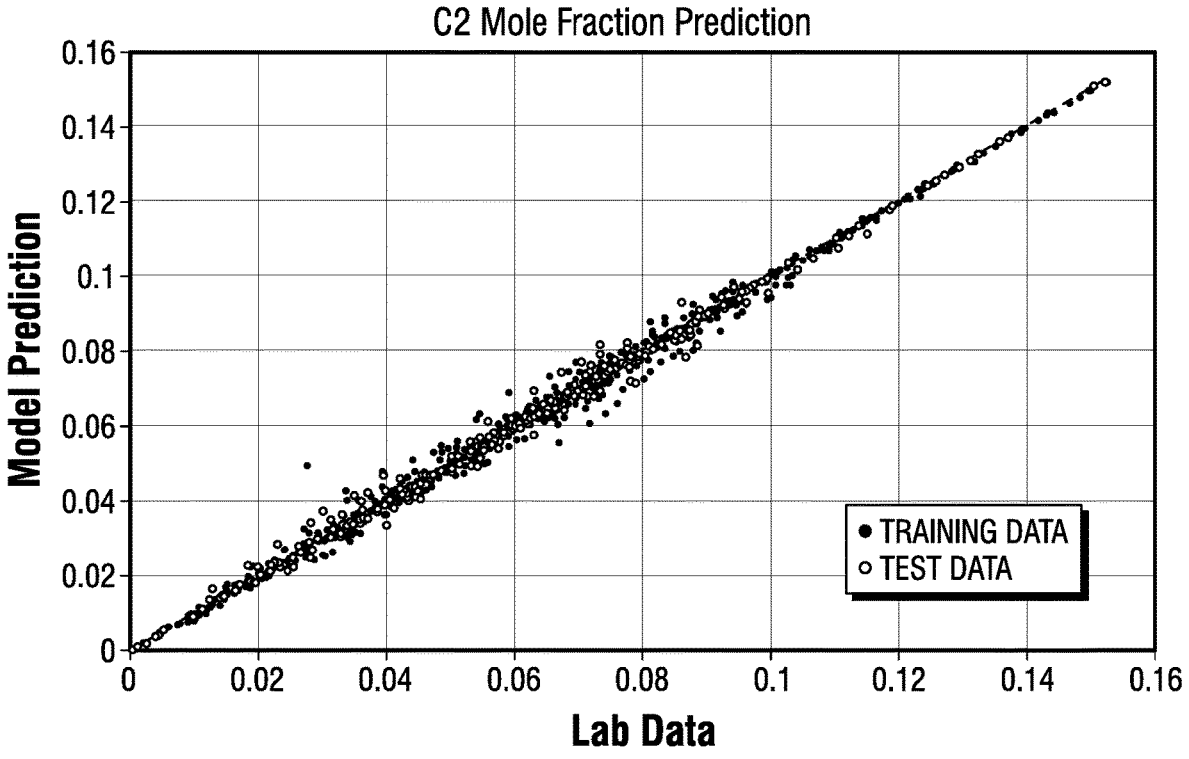
FIG. 16 is a graph depicting one or more aspects of an example implementation according to one or more aspects of the present disclosure.
Figure 17:
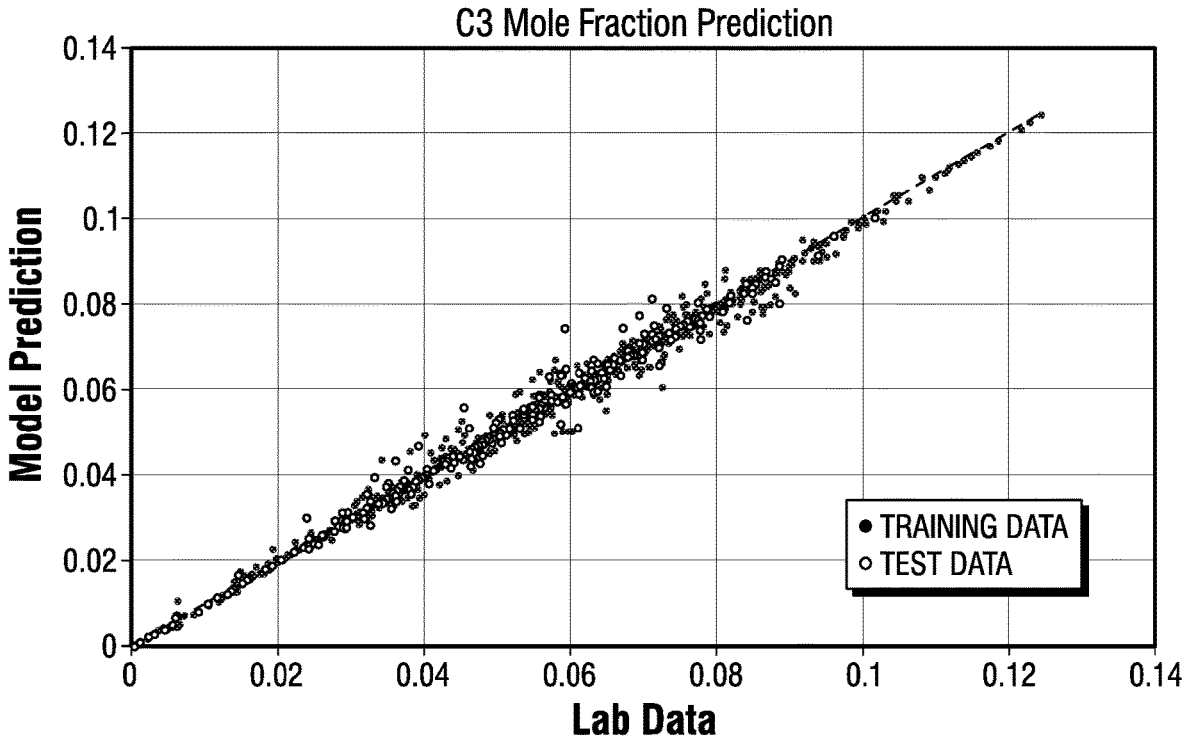
FIG. 17 is a graph depicting one or more aspects of an example implementation according to one or more aspects of the present disclosure.
Figure 18:
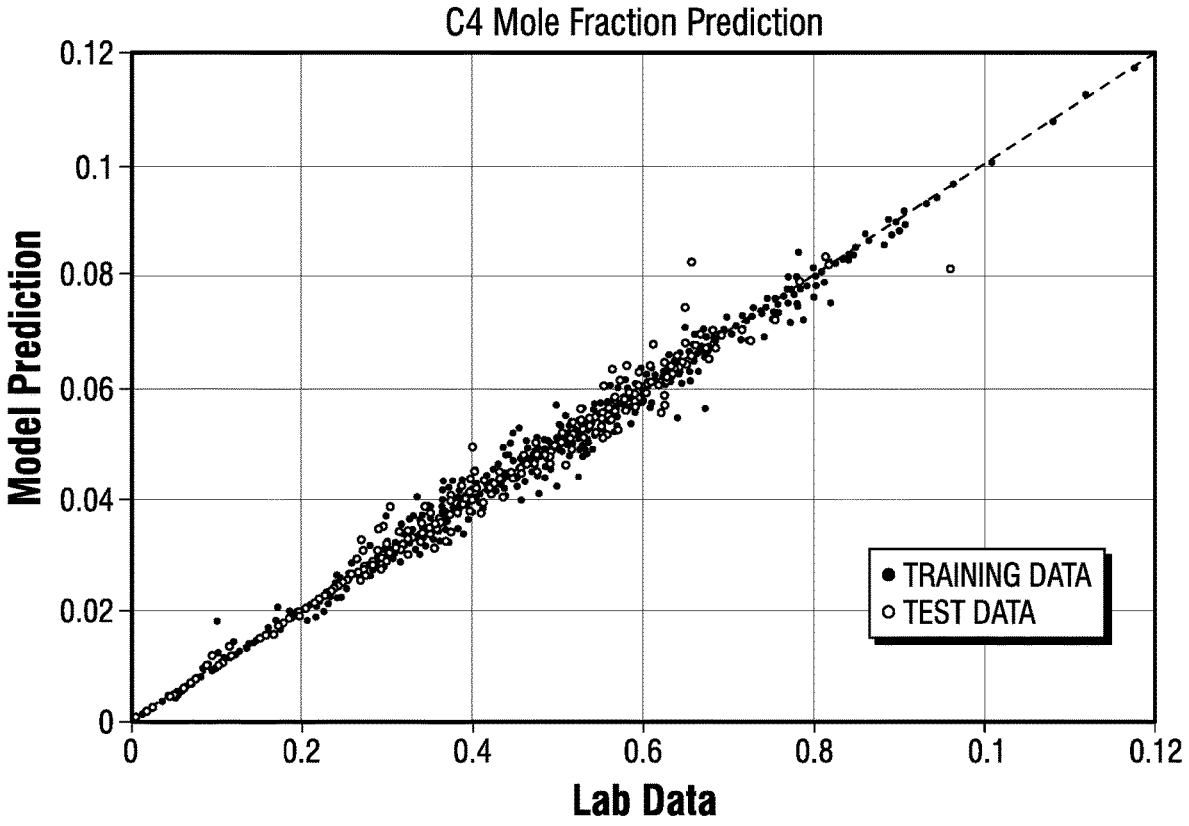
FIG. 18 is a graph depicting one or more aspects of an example implementation according to one or more aspects of the present disclosure.
Figure 19:
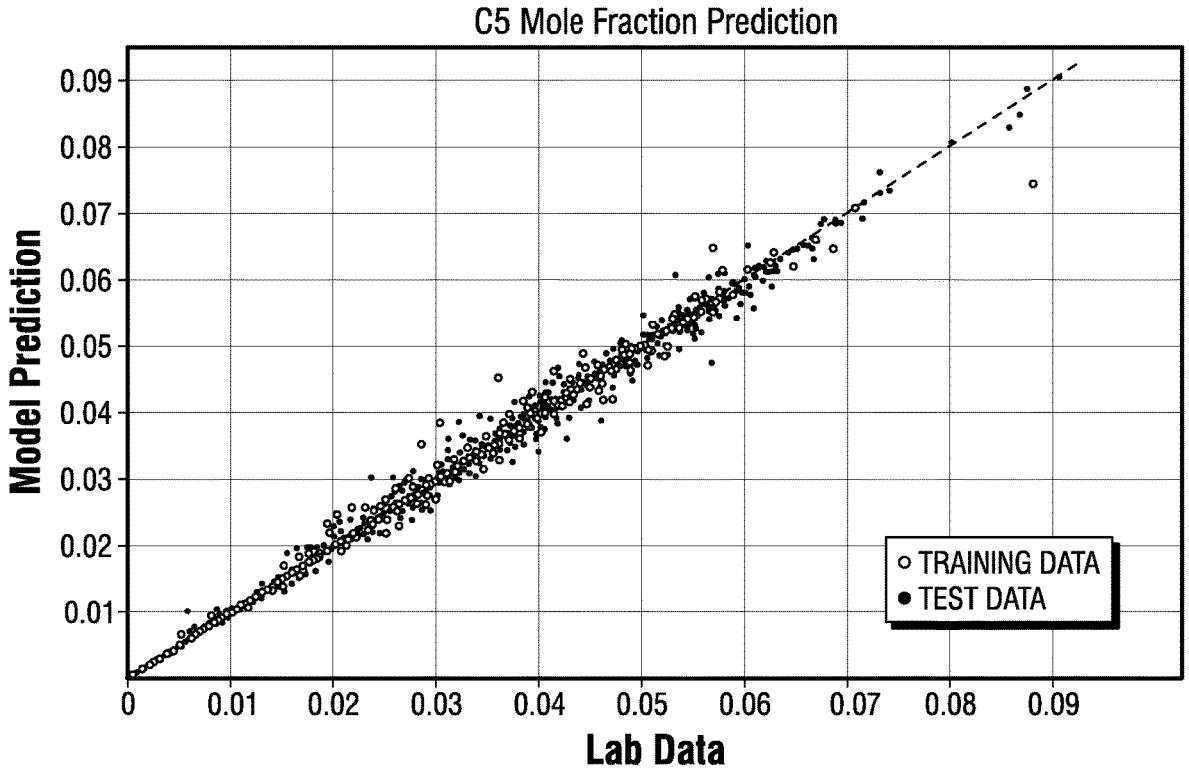
FIG. 19 is a graph depicting one or more aspects of an example implementation according to one or more aspects of the present disclosure.

FIG. 14 is a graph showing training data used to train a SVM and test data for predicting an expected carbon dioxide $CO_2$ mole fraction $x_0$ from an experiment implementing one or more aspects of the present disclosure. FIG. 15 is a graph showing training data used to train a SVM and test data for predicting an expected hydrocarbon C1 mole fraction $x_1$ from an experiment implementing one or more aspects of the present disclosure. FIG. 16 is a graph showing training data used to train a SVM and test data for predicting an expected hydrocarbon C2 mole fraction $x_2$ from an experiment implementing one or more aspects of the present disclosure. FIG. 17 is a graph showing training data used to train a SVM and test data for predicting an expected hydrocarbon C3 mole fraction $x_3$ from an experiment implementing one or more aspects of the present disclosure. FIG. 18 is a graph showing training data used to train a SVM and test data for predicting an expected hydrocarbon C4 mole fraction $x_4$ from an experiment implementing one or more aspects of the present disclosure. FIG. 19 is a graph showing training data used to train a SVM and test data for predicting an expected hydrocarbon C5 mole fraction $x_5$ from an experiment implementing one or more aspects of the present disclosure. The graphs of FIGS. 14-20 shows that the test data caused respective predictions near the line having a slope of one (1), e.g., the respective predicted mole fraction closely approximated the respective lab tested mole fraction.

Figure 20:
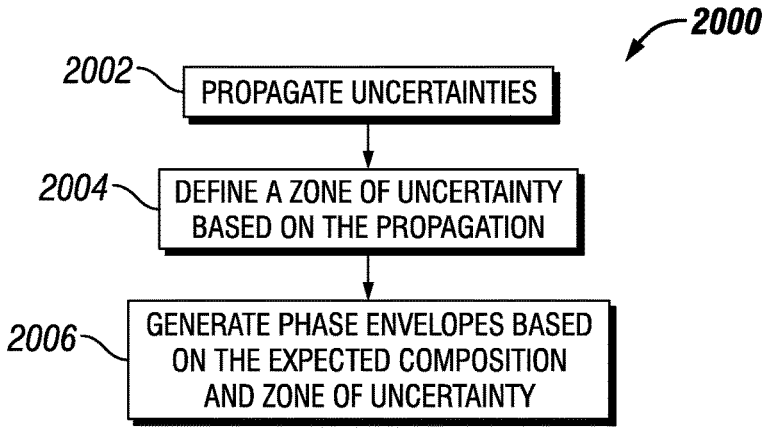
FIG. 20 is a flow-chart diagram of at least a portion of an example implementation of a method according to one or more aspects of the present disclosure.

FIG. 20 is a flow-chart diagram of at least a portion of an example implementation of a method (2000) for determining an expected phase behavior of a fluid, as described above with respect to the phase envelope generation (510) depicted in FIG. 5. The method (2000) may be performed by a processing system, such as illustrated in FIGS. 3 and 4 and may be performed at a wellsite location, for example. The method (2000) may be performed in conjunction with fluid sampling using a downhole fluid sampling tool to obtain in situ, real-time information to inform operation decisions.

Uncertainties that arise from generating the expected compositional component mole fractions X are propagated (2002) to the compositional component mole fractions X. Uncertainties may arise from generating the expected compositional component mole fractions X. For example, a sensor for detecting the weight fractions can have an uncertainty based on physical constraints of the sensor. Additional, the contamination correction process can introduce some uncertainty to the weight fractions that are corrected. Further, the generation of the expected hydrocarbons C6+ mole fraction $x_6$ using a machine learning algorithm can introduce uncertainty to the expected hydrocarbons C6+ mole fraction $x_6$. Additionally, the uncertainty of the expected hydrocarbons C6+ mole fraction $x_6$ can cause uncertainty of the other expected compositional component (e.g., $CO_2$, C1, C2, C3, C4, and C5) mole fractions (e.g., $x_0$, $x_1$, $x_2$, $x_3$, $x_4$, and $x_5$) that are calculated based on the expected hydrocarbons C6+ mole fraction $x_6$. These uncertainties can be propagated to the expected compositional component mole fractions X using a propagation of uncertainty technique.

A zone of uncertainty is defined (2004) based on the uncertainties of the expected compositional component mole fractions X. The zone of uncertainty may identify a range of compositions in which the actual composition of the fluid is expected to be within a statistical error. In some example implementations, the zone of uncertainty may be defined from the positive and negative deviation of the expected compositional component mole fractions X. In some example implementations, for example when the number of expected compositional components is high, a Monte Carlo simulation may be performed by sampling mole factions within respective ranges of uncertainty, and the zone of uncertainty may be defined as compositions within a number of standard deviations of the results of the Monte Carlo simulation, for example, between one, two, etc. standard deviations.

Phase envelopes of the fluid are generated (2006) based on the expected compositional component mole fractions X of the fluid and the zone of uncertainty. For example, phase envelopes may be generated using a thermodynamic model, such as a cubic EoS, Peng-Robinson EoS, or the like. An expected phase envelope may be generated using the expected composition of the fluid. Other phase envelopes may be generated using one or more of the uncertainties of the expected compositional component mole fractions X. The phase envelopes can define a deviation range for a phase envelope of the fluid. Additional details and examples of some example uncertainties and phase envelopes are described below and illustrated in following figures.

Figure 21:
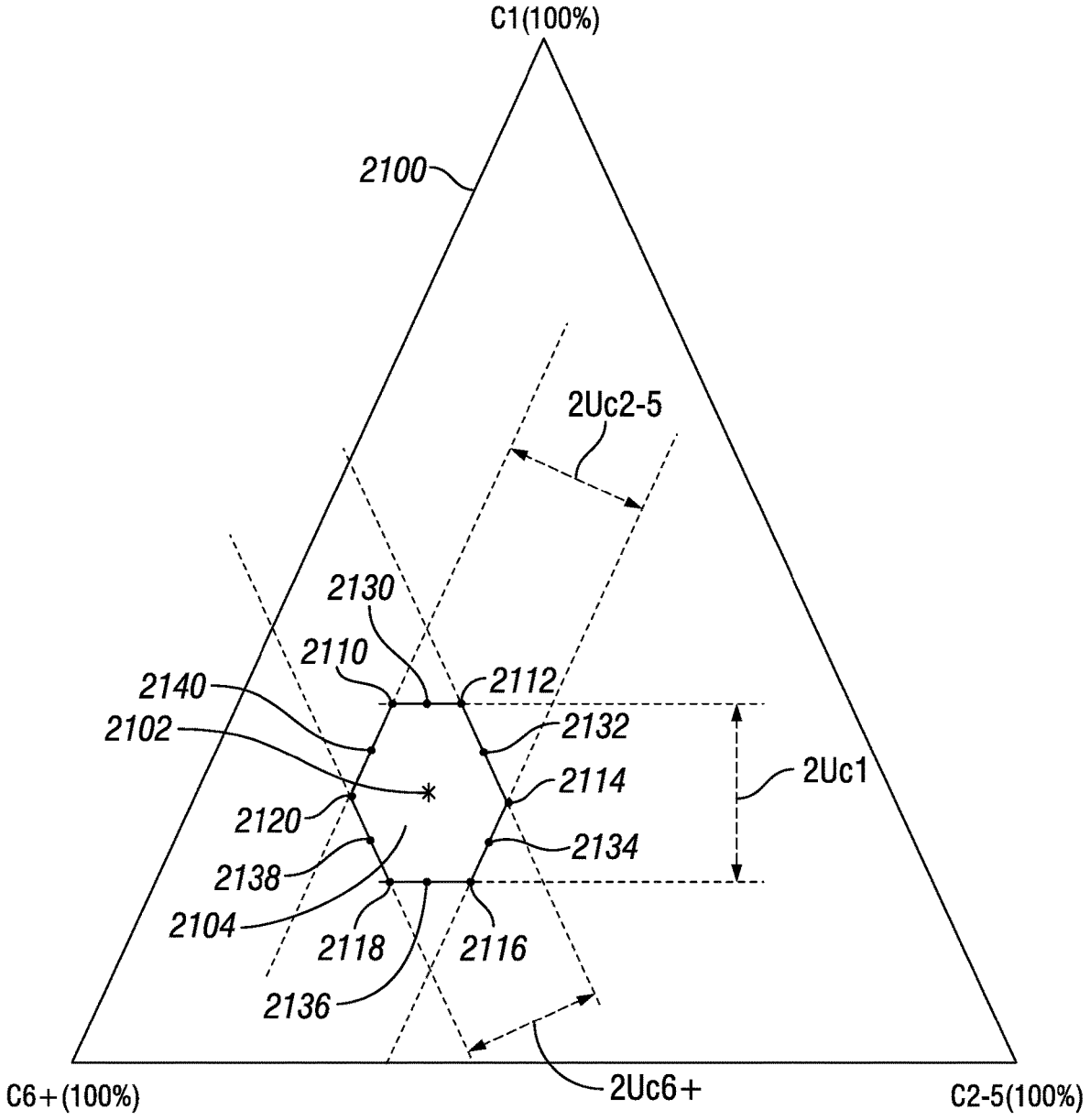
FIG. 21 is a graph depicting one or more aspects of an example implementation according to one or more aspects of the present disclosure.

FIG. 21 is a ternary graph 2100 showing an expected hydrocarbon composition 2102 and a zone of uncertainty 2104 illustrating one or more aspects of an example implementation of the present disclosure. The variables of the ternary graph 2100 include a percentage of hydrocarbon C1, a percentage of grouped hydrocarbons C2, C3, C4, and C5 (e.g., C2-5), and a percentage of grouped hydrocarbons C6+. In other examples, different compositional components of the fluid may be used or included, such as $CO_2$, $H_2S$, $N_2$, and/or the like. Further, in other examples, the compositional components may be grouped differently or may be analyzed individually. The expected hydrocarbon composition 2102 of the fluid is shown. The expected hydrocarbon composition 2102 may be determined using methods (600) and (700) previously described. The expected hydrocarbon composition 2102 is within the zone of uncertainty 2104. The zone of uncertainty 2104 is illustrated as a hexagon defined by uncertainties of the variables (e.g., respective percentages of hydrocarbon C1, hydrocarbons C2-5, and hydrocarbons C6+). The uncertainty of the variable may be determined by propagation of uncertainties as described above. A hydrocarbon C1 uncertainty $U_{c1}$ is shown with a positive deviation from the expected hydrocarbon composition 2102 and with a negative deviation from the expected hydrocarbon composition 2102, and hence, the zone of uncertainty 2104 is defined by two times the hydrocarbon C1 uncertainty $2U_{c1}$. The hydrocarbons C2-5 uncertainty $U_{c2-5}$ and the hydrocarbons C6+ uncertainty $U_{c6+}$ are similarly shown and further define the zone of uncertainty 2104 by two times the respective hydrocarbons C2-5 uncertainty $2U_{c2-5}$ and the hydrocarbons C6+ uncertainty $2U_{c6+}$.

Figure 22:
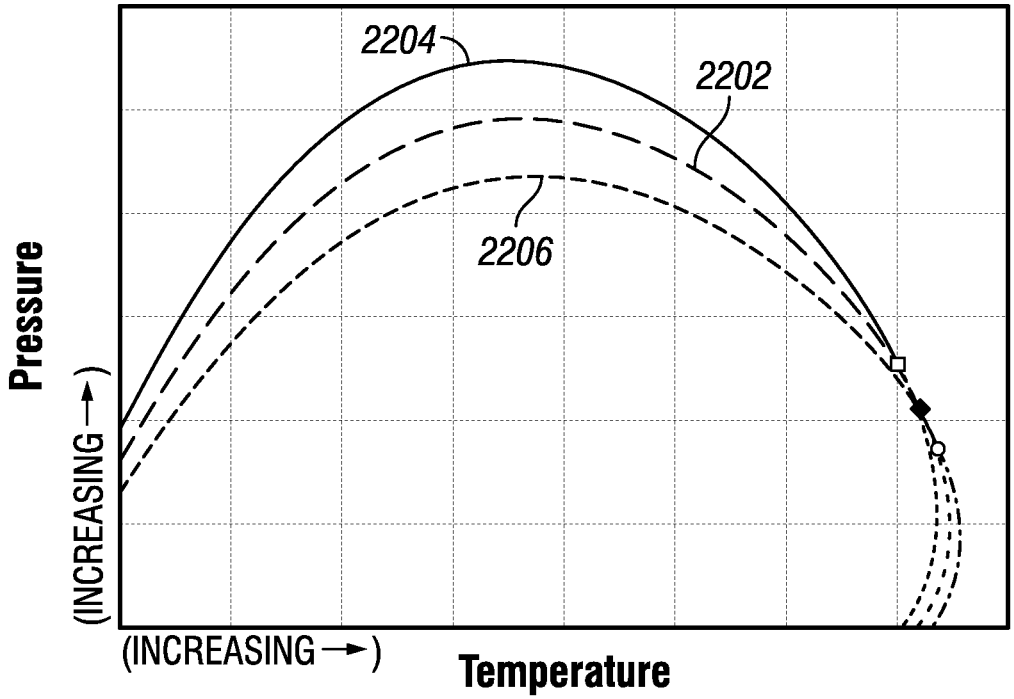
FIG. 22 is a graph depicting one or more aspects of an example implementation according to one or more aspects of the present disclosure.
Figure 23:
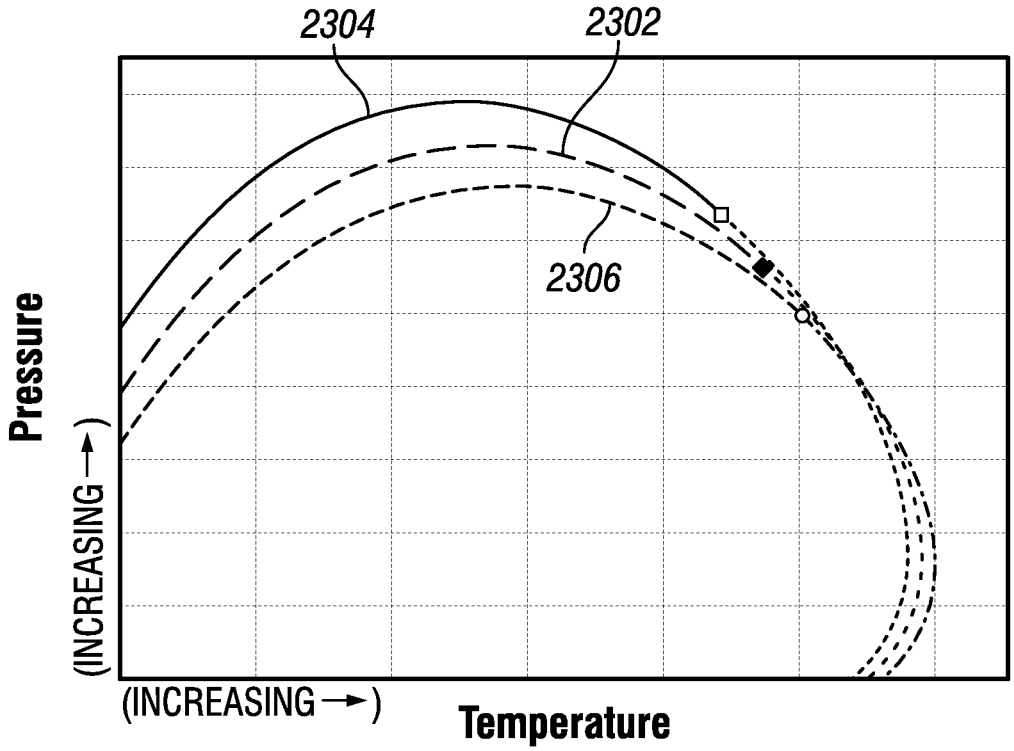
FIG. 23 is a graph depicting one or more aspects of an example implementation according to one or more aspects of the present disclosure.
Figure 24:
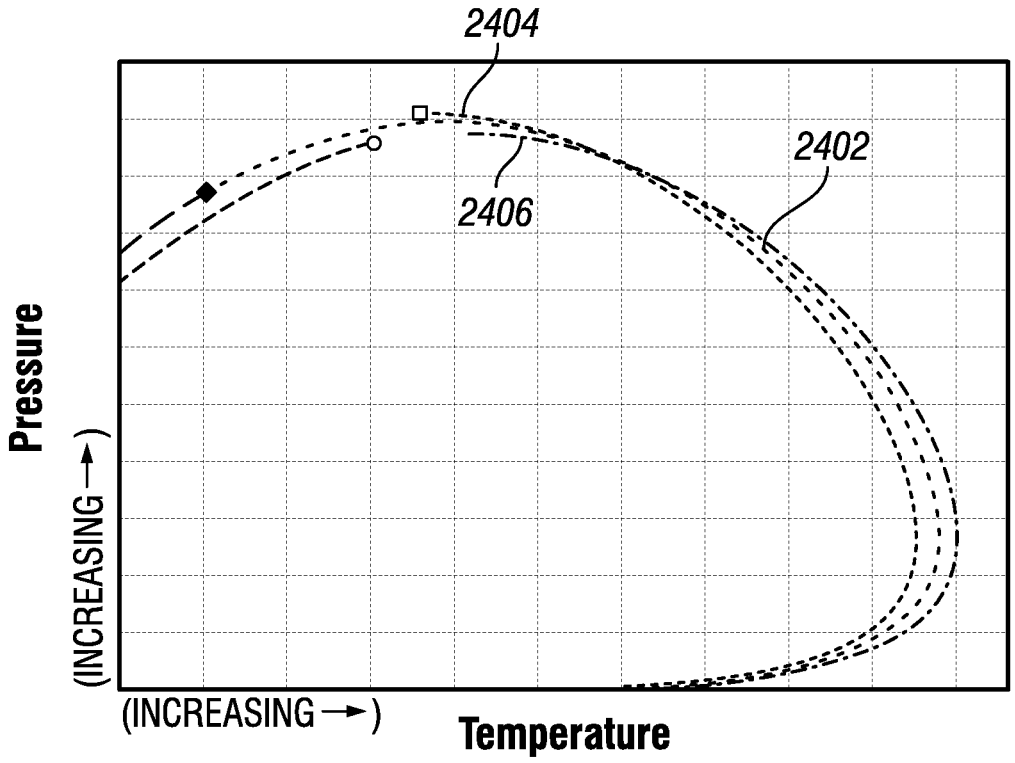
FIG. 24 is a graph depicting one or more aspects of an example implementation according to one or more aspects of the present disclosure.

FIGS. 22-24 are graphs having example phase envelopes illustrating one or more aspects of example implementations of the present disclosure. FIG. 22 illustrates phase envelopes for black oil and shows an expected phase envelope 2202, a first deviation phase envelope 2204, and a second deviation phase envelope 2206. FIG. 23 illustrates phase envelopes for volatile oil and shows an expected phase envelope 2302, a first deviation phase envelope 2304, and a second deviation phase envelope 2306. FIG. 24 illustrates phase envelopes for condensate gas and shows an expected phase envelope 2402, a first deviation phase envelope 2404, and a second deviation phase envelope 2406.

In the examples of FIGS. 22-24, the expected phase envelopes 2202, 2302, and 2402 may be obtained by using the expected composition (e.g., as determined by method (700)) in a thermodynamic model, such as an EoS like a cubic EoS, or the like. The first deviation phase envelopes 2204, 2304, and 2404 and the second deviation phase envelopes 2206, 2306, and 2406 may be obtained by various methods, and a few examples to obtain these phase envelopes are described herein. Other methods for determining the deviation phase envelopes may be used.

In some examples, the percentages of the compositional components (or groups of compositional components) for deviation compositions used to obtain deviation phase envelopes may be specified at various points along a boundary of a zone of uncertainty around the expected composition of the fluid. As an example, intersection points of boundaries of the zone of uncertainty may be used in a thermodynamic model. The resultant phase envelope that has a largest deviation above the expected phase envelope before intersecting with the expected phase envelope and below the expected phase envelope after intersecting with the expected phase envelope may be the first deviation phase envelope (e.g., the first deviation phase envelopes 2204, 2304, and 2404). The resultant phase envelope that has a largest deviation below the expected phase envelope before intersecting with the expected phase envelope and above the expected phase envelope after intersecting with the expected phase envelope may be the second deviation phase envelope (e.g., the second deviation phase envelopes 2206, 2306, and 2406).

Using FIG. 21 as a reference for this example, corner points 2110, 2112, 2114, 2116, 2118, and 2120 are illustrated as example intersection points of boundaries of the zone of uncertainty 2104. For example, the corner points 2110, 2112, 2114, 2116, 2118, and 2120 are at respective intersections of at least two boundaries resulting from respective uncertainties of at least two hydrocarbon components in the ternary graph of FIG. 21. Higher dimensional analysis can include intersections of more boundaries, for example. In this example, assume that the expected hydrocarbon composition 2102 is 20% of hydrocarbon C1, 20% of hydrocarbons C2-5, and 60% of hydrocarbons C6+ with the hydrocarbon C1 uncertainty $U_{c1}$ being +/−4%, the hydrocarbons C2-5 uncertainty $U_{c2-5}$ being +/−5%, and the hydrocarbons C6+ uncertainty $U_{c6+}$ being +/−6%. The following example deviation compositions may be used in a thermodynamic model to determine the first and second deviation phase envelopes:

Corner point 2110: 24% of C1, 15% of C2-5, and 61% of C6+

Corner point 2112: 24% of C1, 22% of C2-5, and 54% of C6+

Corner point 2114: 21% of C1, 25% of C2-5, and 54% of C6+

Corner point 2116: 16% of C1, 25% of C2-5, and 59% of C6+

Corner point 2118: 16% of C1, 18% of C2-5, and 66% of C6+

Corner point 2120: 19% of C1, 15% of C2-5, and 66% of C6+

In another example of specified points along a boundary of a zone of uncertainty, midpoints along respective boundaries of the zone of uncertainty may be used in a thermodynamic model. The resultant phase envelope that has a largest deviation above the expected phase envelope before intersecting with the expected phase envelope and below the expected phase envelope after intersecting with the expected phase envelope may be the first deviation phase envelope (e.g., the first deviation phase envelopes 2204, 2304, and 2404). The resultant phase envelope that has a largest deviation below the expected phase envelope before intersecting with the expected phase envelope and above the expected phase envelope after intersecting with the expected phase envelope may be the second deviation phase envelope (e.g., the second deviation phase envelopes 2206, 2306, and 2406).

Using FIG. 21 as a reference for this example, midpoints 2130, 2132, 2134, 2136, 2138, and 2140 are illustrated as example midpoints of respective boundaries of the zone of uncertainty 2104. For example, the midpoints 2130, 2132, 2134, 2136, 2138, and 2140 are at respective middle points of lines that define the boundaries of the zone of uncertainty 2104 in the ternary graph of FIG. 21. Higher dimensional analysis can include different types of boundaries, such as, for example, a surface. In this example, assume that the expected hydrocarbon composition 2102 is 20% of hydrocarbon C1, 20% of hydrocarbons C2-5, and 60% of hydrocarbons C6+ with the hydrocarbon C1 uncertainty $U_{c1}$ being +/−4%, the hydrocarbons C2-5 uncertainty $U_{c2-5}$ being +/−5%, and the hydrocarbons C6+ uncertainty $U_{c6+}$ being +/−6%. The following example deviation compositions may be used in a thermodynamic model to determine the first and second deviation phase envelopes:

Midpoint 2130: 24% of C1, 18.5% of C2-5, and 57.5% of C6+

Midpoint 2132: 22.5% of C1, 23.5% of C2-5, and 54% of C6+

Midpoint 2134: 18.5% of C1, 25% of C2-5, and 56.5% of C6+

Midpoint 2136: 16% of C1, 21.5% of C2-5, and 62.5% of C6+

Midpoint 2138: 17.5% of C1, 16.5% of C2-5, and 66% of C6+

Midpoint 2140: 21.5% of C1, 15% of C2-5, and 63.5% of C6+

A further example includes randomly sampling a number of compositions within a zone of uncertainty. For example, a Monte Carlo simulation may be used to randomly sample compositions with the zone of uncertainty 2104, to use FIG. 21 as an example reference. The sampled compositions with respective phase envelopes that are a number of standard deviations, such as one, two, etc., from the expected phase envelope may be used to define the deviation phase envelopes. For example, sampled compositions that result in phase envelopes that are two standard deviations from the expected phase envelope based on the sampling are determined to define the first and second deviation phase envelopes, and hence, approximately 95% of the phase envelopes that result from the sampling fall within the deviation range (e.g., +/− two standard deviations from the expected phase envelope resulting in a range of four standard deviations) defined by the first and second deviation phase envelopes.

In view of the entirety of the present disclosure, including the claims and the figures, a person having ordinary skill in the art will readily recognize that the present disclosure introduces an apparatus comprising a processing system comprising a processor and a memory including computer program code, and a method of operating the processing system to: obtain first properties of a fluid; estimate, using a machine learning algorithm, a second property of the fluid based on the first properties; propagate a first uncertainty of the first properties to a second uncertainty of the second property; generate an expected phase envelope of the fluid based on the second property; and generate a deviation phase envelope of the fluid based on the second uncertainty.

The method may comprise operating the processing system to: quantify a contamination level of the fluid; and correct the first properties based on the contamination level, wherein the estimating may be based on the corrected first properties.

The machine learning algorithm may be selected from a group consisting of an artificial neural network (ANN), multivariate regression, and a support vector machine (SVM).

The method may comprise operating the processing system to select the machine learning algorithm from a plurality of machine learning algorithms based on a type of the fluid. For example, an oil-type machine learning algorithm may be selected as the machine learning algorithm from the plurality of machine learning algorithms when the type of the fluid is liquid oil, and a gas-type machine learning algorithm may be selected as the machine learning algorithm from the plurality of machine learning algorithms when the type of the fluid is gas. The method may comprise operating the processing system to determine the type of the fluid based on at least one: a gas-oil ratio (GOR) of the fluid; and a mass ratio of a mass of hydrocarbon C1 to a mass of hydrocarbons C6+.

The machine learning algorithm may be trained from historical samples of fluids with respective carbon dioxide $CO_2$ weight fractions, respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm and with respective hydrocarbons C6+ mole fractions as outputs of the machine learning algorithm.

The first properties may be compositional component weight fractions of the fluid, and the compositional component weight fractions may include a carbon dioxide $CO_2$ weight fraction, a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction. The second property may be a hydrocarbons C6+ mole fraction. The method may comprise operating the processing system to calculate compositional component mole fractions based on the hydrocarbons C6+ mole fraction, wherein the compositional component mole fractions may include a carbon dioxide $CO_2$ mole fraction, a hydrocarbon C1 mole fraction, a hydrocarbon C2 mole fraction, a hydrocarbon C3 mole fraction, a hydrocarbon C4 mole fraction, and a hydrocarbon C5 mole fraction. The method may comprise operating the processing system to: calculate a hydrocarbons C6+ molar mass based on the hydrocarbons C6+ mole fraction; and calculate compositional component mole fractions based on the hydrocarbons C6+ mole fraction and the hydrocarbons C6+ molar mass, wherein the compositional component mole fractions may include a carbon dioxide $CO_2$ mole fraction, a hydrocarbon C1 mole fraction, a hydrocarbon C2 mole fraction, a hydrocarbon C3 mole fraction, a hydrocarbon C4 mole fraction, and a hydrocarbon C5 mole fraction. Propagating the first uncertainty to the second uncertainty may include propagating first uncertainties corresponding to the carbon dioxide $CO_2$ weight fraction, the hydrocarbon C1 weight fraction, the hydrocarbon C2 weight fraction, the hydrocarbon C3 weight fraction, the hydrocarbon C4 weight fraction, the hydrocarbon C5 weight fraction, and the hydrocarbons C6+ weight fraction to second uncertainties of the carbon dioxide $CO_2$ mole fraction, the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction. Generating the expected phase envelope of the fluid may include generating the expected phase envelope based on an expected composition of the fluid, wherein the expected composition may include the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction. Generating the deviation phase envelope of the fluid may include: generating a first deviation phase envelope of the fluid based on one or more of the second uncertainties; and generating a second deviation phase envelope of the fluid based on one or more of the second uncertainties, wherein the first deviation phase envelope and the second deviation phase envelope may define a deviation range, and the expected phase envelope may be disposed in the deviation range.

The first properties may be compositional component weight fractions of the fluid, and the compositional component weight fractions may include a carbon dioxide $CO_2$ weight fraction, a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction. The second property may include compositional component mole fractions of the fluid, and the compositional component mole fractions may include a carbon dioxide $CO_2$ mole fraction, a hydrocarbon C1 mole fraction, a hydrocarbon C2 mole fraction, a hydrocarbon C3 mole fraction, a hydrocarbon C4 mole fraction, a hydrocarbon C5 mole fraction, and a hydrocarbons C6+ mole fraction.

The present disclosure also introduces an apparatus comprising a processing system comprising a processor and a memory including computer program code, and a method of operating the processing system to: obtain compositional component weight fractions of a fluid, wherein the compositional component weight fractions include a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction; estimate, using a machine learning algorithm, a hydrocarbons C6+ mole fraction of the fluid based on the compositional component weight fractions; generate a hydrocarbons C6+ molar mass based on the hydrocarbons C6+ mole fraction; and generate compositional component mole fractions based on the hydrocarbons C6+ molar mass and the hydrocarbons C6+ mole fraction, wherein the compositional component mole fractions include a hydrocarbon C1 mole fraction, a hydrocarbon C2 mole fraction, a hydrocarbon C3 mole fraction, a hydrocarbon C4 mole fraction, and a hydrocarbon C5 mole fraction.

The compositional component weight fractions may further include a carbon dioxide $CO_2$ weight fraction, a hydrogen sulfide $H_2S$ weight fraction, a nitrogen $N_2$ weight fraction, or a combination thereof.

The method may comprise operating the processing system to: quantify a contamination level of the fluid; and correct the compositional component weight fractions based on the contamination level, wherein the estimating may be based on the corrected compositional component weight fractions.

The machine learning algorithm may be selected from a group consisting of an artificial neural network (ANN), multivariate regression, and a support vector machine (SVM).

The method may comprise operating the processing system to select the machine learning algorithm from a plurality of machine learning algorithms based on a type of the fluid. For example, an oil-based machine learning algorithm may be selected as the machine learning algorithm from the plurality of machine learning algorithms when the type of the fluid is liquid oil, and a gas-based machine learning algorithm may be selected as the machine learning algorithm from the plurality of machine learning algorithms when the type of the fluid is gas. The method may comprise operating the processing system to determine the type of the fluid based on at least one of: a gas-oil ratio (GOR) of the fluid; and a mass ratio of a mass of hydrocarbon C1 to a mass of hydrocarbons C6+.

The machine learning algorithm may be trained from historical samples of fluid with respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm and with respective hydrocarbons C6+ mole fractions as outputs of the machine learning algorithm.

The method may comprise operating the processing system to: propagate first uncertainties corresponding to the hydrocarbon C1 weight fraction, the hydrocarbon C2 weight fraction, the hydrocarbon C3 weight fraction, the hydrocarbon C4 weight fraction, the hydrocarbon C5 weight fraction, and the hydrocarbons C6+ weight fraction to second uncertainties of the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction; generate an expected phase envelope based on the compositional component mole fractions and the hydrocarbons C6+ mole fraction; generate a first deviation phase envelope of the fluid based on one or more of the second uncertainties; and generate a second deviation phase envelope of the fluid based on one or more of the second uncertainties, wherein the first deviation phase envelope and the second deviation phase envelope may define a deviation range, and the expected phase envelope may be disposed in the deviation range. A first one of the second uncertainties may be an uncertainty of the hydrocarbon C1 mole fraction. A second one of the second uncertainties may be an uncertainty of a combined group the hydrocarbon C2 mole fraction, hydrocarbon C3 mole fraction, hydrocarbon C4 mole fraction, and hydrocarbon C5 mole fraction. A third one of the second uncertainties may be an uncertainty of the hydrocarbons C6+ mole fraction.

The present disclosure also introduces an apparatus comprising a processing system having a processor and a memory including computer program code, and a method of operating the processing system to: estimate expected hydrocarbon mole fractions of a fluid; propagate uncertainties to the expected hydrocarbon mole fractions based on the estimating; generate an expected phase envelope of the fluid based on the expected hydrocarbon mole fractions; and generate a deviation phase envelope of the fluid based on one or more of the uncertainties.

Generating the deviation phase envelope may include generating at least two deviation phase envelopes of the fluid based on one or more of the uncertainties, wherein the at least two deviation phase envelopes may define a deviation range, and the expected phase envelope may be disposed in the deviation range.

The expected hydrocarbon mole fractions may include: a hydrocarbon C1 mole fraction; a hydrocarbon C2 mole fraction; a hydrocarbon C3 mole fraction; a hydrocarbon C4 mole fraction; a hydrocarbon C5 mole fraction; and a hydrocarbons C6+ mole fraction.

Estimating the expected hydrocarbon mole fractions may include using a machine learning algorithm. The machine learning algorithm may be selected from a group consisting of an artificial neural network (ANN), multivariate regression, and a support vector machine (SVM). The method may comprise operating the processing system to select the machine learning algorithm from a plurality of machine learning algorithms based on a type of the fluid. The machine learning algorithm may be trained from historical samples of fluids with respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm and with respective hydrocarbons C6+ mole fractions as outputs of the machine learning algorithm. Estimating the expected hydrocarbon mole fractions may include: inputting a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight of the fluid into the machine learning algorithm; obtaining, from the machine learning algorithm, a hydrocarbons C6+ mole fraction of the fluid; calculating a hydrocarbons C6+ molar mass of the fluid based on the hydrocarbons C6+ mole fraction; and calculating a hydrocarbon C1 mole fraction, a hydrocarbon C2 mole fraction, a hydrocarbon C3 mole fraction, a hydrocarbon C4 mole fraction, and a hydrocarbon C5 mole fraction based on the hydrocarbons C6+ molar mass and the hydrocarbons C6+ mole fraction, wherein the expected hydrocarbon mole fractions may include the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction. The machine learning algorithm may be trained from historical samples of fluids with respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm and with respective hydrocarbon C1 mole fractions, respective hydrocarbon C2 mole fractions, respective hydrocarbon C3 mole fractions, respective hydrocarbon C4 mole fractions, respective hydrocarbon C5 mole fractions, and respective hydrocarbons C6+ mole fractions as outputs of the machine learning algorithm. Estimating the expected hydrocarbon mole fractions may include: inputting a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight of the fluid into the machine learning algorithm; and obtaining, from the machine learning algorithm, a hydrocarbon C1 mole fraction, a hydrocarbon C2 mole fraction, a hydrocarbon C3 mole fraction, a hydrocarbon C4 mole fraction, a hydrocarbon C5 mole fraction, and a hydrocarbons C6+ mole fraction of the fluid.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a processing system comprising a processor and a memory including computer program code, wherein the processing system is operable to:

obtain first properties of a fluid;

estimate, using a machine learning algorithm, a second property of the fluid based on the first properties;

propagate a first uncertainty of the first properties to a second uncertainty of the second property;

generate an expected phase envelope of the fluid based on the second property; and generate a deviation phase envelope of the fluid based on the second uncertainty;

wherein the first properties are compositional component weight fractions of the fluid that include a carbon dioxide $CO_2$ weight fraction, a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction; and the second property is a hydrocarbons C6+ mole fraction;

wherein the processing system is further operable to calculate compositional component mole fractions based on the hydrocarbons C6+ mole fraction, and wherein the compositional component mole fractions include a carbon dioxide CO2 mole fraction, a hydrocarbon C1 mole fraction, a hydrocarbon C2 mole fraction, a hydrocarbon C3 mole fraction, a hydrocarbon C4 mole fraction, and a hydrocarbon C5 mole fraction;

wherein propagating the first uncertainty to the second uncertainty includes propagating first uncertainties corresponding to the carbon dioxide CO2 weight fraction, the hydrocarbon C1 weight fraction, the hydrocarbon C2 weight fraction, the hydrocarbon C3 weight fraction, the hydrocarbon C4 weight fraction, the hydrocarbon C5 weight fraction, and the hydrocarbons C6+ weight fraction to second uncertainties of the carbon dioxide CO2 mole fraction, the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction;

generating the expected phase envelope of the fluid includes generating the expected phase envelope based on an expected composition of the fluid, wherein the expected composition includes at least the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction; and generating the deviation phase envelope of the fluid includes:

generating a first deviation phase envelope of the fluid based on one or more of the second uncertainties; and generating a second deviation phase envelope of the fluid based on one or more of the second uncertainties, wherein the first deviation phase envelope and the second deviation phase envelope define a deviation range, and wherein the expected phase envelope is disposed in the deviation range.

2. The apparatus of claim 1 wherein the processing system is further operable to:

quantify a contamination level of the fluid; and correct the first properties based on the contamination level, wherein the estimating is based on the corrected first properties.

3. The apparatus of claim 1 wherein the processing system is further operable to:

select the machine learning algorithm from a plurality of machine learning algorithms based on a type of the fluid; and determine the type of the fluid based on at least one of a gas-oil ratio (GOR) of the fluid and a mass ratio of a mass of hydrocarbon C1 to a mass of hydrocarbons C6+.

4. The apparatus of claim 1 wherein the machine learning algorithm is trained from historical samples of fluids with respective carbon dioxide $CO_2$ weight fractions, respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm and with respective hydrocarbons C6+ mole fractions as outputs of the machine learning algorithm.

5. The apparatus of claim 1 wherein:

the first properties are compositional component weight fractions of the fluid that include a carbon dioxide $CO_2$ weight fraction, a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction; and the second property includes compositional component mole fractions of the fluid that include a carbon dioxide $CO_2$ mole fraction, a hydrocarbon C1 mole fraction, a hydrocarbon C2 mole fraction, a hydrocarbon C3 mole fraction, a hydrocarbon C4 mole fraction, a hydrocarbon C5 mole fraction, and a hydrocarbons C6+ mole fraction.

6. The apparatus of claim 1 wherein the processing system is further operable to:

calculate a hydrocarbons C6+ molar mass based on the hydrocarbons C6+ mole fraction; and calculate compositional component mole fractions based on the hydrocarbons C6+ mole fraction and the hydrocarbons C6+ molar mass, wherein the compositional component mole fractions include a carbon dioxide $CO_2$ mole fraction, a hydrocarbon C1 mole fraction, a hydrocarbon C2 mole fraction, a hydrocarbon C3 mole fraction, a hydrocarbon C4 mole fraction, and a hydrocarbon C5 mole fraction.

7. An apparatus comprising:

a processing system comprising a processor and a memory including computer program code, wherein the processing system is operable to:

obtain compositional component weight fractions of a fluid, wherein the compositional component weight fractions include a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight fraction;

estimate, using a machine learning algorithm, a hydrocarbons C6+ mole fraction of the fluid based on the compositional component weight fractions;

generate a hydrocarbons C6+ molar mass based on the hydrocarbons C6+ mole fraction; and generate compositional component mole fractions based on the hydrocarbons C6+ molar mass and the hydrocarbons C6+ mole fraction, wherein the compositional component mole fractions include a hydrocarbon C1 mole fraction, a hydrocarbon C2 mole fraction, a hydrocarbon C3 mole fraction, a hydrocarbon C4 mole fraction, and a hydrocarbon C5 mole fraction;

wherein the processing system is further operable to:

propagate first uncertainties corresponding to the hydrocarbon C1 weight fraction, the hydrocarbon C2 weight fraction, the hydrocarbon C3 weight fraction, the hydrocarbon C4 weight fraction, the hydrocarbon C5 weight fraction, and the hydrocarbons C6+ weight fraction to second uncertainties of the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction;

generate an expected phase envelope based on the compositional component mole fractions and the hydrocarbons C6+ mole fraction;

generate a first deviation phase envelope of the fluid based on one or more of the second uncertainties; and generate a second deviation phase envelope of the fluid based on one or more of the second uncertainties, wherein the first deviation phase envelope and the second deviation phase envelope define a deviation range, the expected phase envelope being disposed in the deviation range.

8. The apparatus of claim 7 wherein the compositional component weight fractions further include a carbon dioxide $CO_2$ weight fraction, a hydrogen sulfide $H_2S$ weight fraction, a nitrogen $N_2$ weight fraction, or a combination thereof.

9. The apparatus of claim 7 wherein the processing system is further operable to:

quantify a contamination level of the fluid; and correct the compositional component weight fractions based on the contamination level, wherein the estimating is based on the corrected compositional component weight fractions.

10. The apparatus of claim 7 wherein:

a first one of the second uncertainties is an uncertainty of the hydrocarbon C1 mole fraction;

a second one of the second uncertainties is an uncertainty of a combined group the hydrocarbon C2 mole fraction, hydrocarbon C3 mole fraction, hydrocarbon C4 mole fraction, and hydrocarbon C5 mole fraction; and a third one of the second uncertainties is an uncertainty of the hydrocarbons C6+ mole fraction.

11. A method comprising:

operating a processing system comprising a processor and a memory including computer program code, wherein operating the processing system comprises:

selecting a machine learning algorithm from a plurality of machine learning algorithms based on a type of a fluid; and each of the plurality of machine learning algorithms is selected from the group consisting of an artificial neural network (ANN), multivariate regression, and a support vector machine (SVM);

estimating expected hydrocarbon mole fractions of the fluid, wherein estimating the expected hydrocarbon mole fractions includes using the machine learning algorithm selected from the plurality of machine learning algorithms;

propagating uncertainties to the expected hydrocarbon mole fractions based on the estimating;

generating an expected phase envelope of the fluid based on the expected hydrocarbon mole fractions; and generating a deviation phase envelope of the fluid based on one or more of the uncertainties;

wherein generating the deviation phase envelope includes generating at least two deviation phase envelopes of the fluid based on one or more of the uncertainties, wherein the at least two deviation phase envelopes define a deviation range, and wherein the expected phase envelope is disposed in the deviation range.

12. The method of claim 11 wherein estimating the expected hydrocarbon mole fractions includes using a machine learning algorithm trained from historical samples of fluids, with respective hydrocarbon C1 weight fractions, respective hydrocarbon C2 weight fractions, respective hydrocarbon C3 weight fractions, respective hydrocarbon C4 weight fractions, respective hydrocarbon C5 weight fractions, and respective hydrocarbons C6+ weight fractions as inputs to the machine learning algorithm, and with respective hydrocarbons C6+ mole fractions as outputs of the machine learning algorithm.

13. The method of claim 11 wherein estimating the expected hydrocarbon mole fractions uses a machine learning algorithm and includes:

inputting a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight of the fluid into the machine learning algorithm;

obtaining, from the machine learning algorithm, a hydrocarbons C6+ mole fraction of the fluid;

calculating a hydrocarbons C6+ molar mass of the fluid based on the hydrocarbons C6+ mole fraction; and calculating a hydrocarbon C1 mole fraction, a hydrocarbon C2 mole fraction, a hydrocarbon C3 mole fraction, a hydrocarbon C4 mole fraction, and a hydrocarbon C5 mole fraction based on the hydrocarbons C6+ molar mass and the hydrocarbons C6+ mole fraction, wherein the expected hydrocarbon mole fractions include the hydrocarbon C1 mole fraction, the hydrocarbon C2 mole fraction, the hydrocarbon C3 mole fraction, the hydrocarbon C4 mole fraction, the hydrocarbon C5 mole fraction, and the hydrocarbons C6+ mole fraction.

14. The method of claim 11 wherein estimating the expected hydrocarbon mole fractions uses a machine learning algorithm and includes:

inputting a hydrocarbon C1 weight fraction, a hydrocarbon C2 weight fraction, a hydrocarbon C3 weight fraction, a hydrocarbon C4 weight fraction, a hydrocarbon C5 weight fraction, and a hydrocarbons C6+ weight of the fluid into the machine learning algorithm; and obtaining, from the machine learning algorithm, a hydrocarbon C1 mole fraction, a hydrocarbon C2 mole fraction, a hydrocarbon C3 mole fraction, a hydrocarbon C4 mole fraction, a hydrocarbon C5 mole fraction, and a hydrocarbons C6+ mole fraction of the fluid.

* * * * *